US011455933B2

(12) United States Patent
Okuda

(10) Patent No.: US 11,455,933 B2
(45) Date of Patent: Sep. 27, 2022

(54) CIRCUIT DEVICE, ELECTRO-OPTICAL DEVICE, AND ELECTRONIC APPARATUS

(71) Applicant: SEIKO EPSON CORPORATION, Tokyo (JP)

(72) Inventor: Akihiko Okuda, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/357,574

(22) Filed: Jun. 24, 2021

(65) Prior Publication Data

US 2021/0407372 A1 Dec. 30, 2021

(30) Foreign Application Priority Data

Jun. 25, 2020 (JP) ..... JP2020-109418

(51) Int. Cl.
*G09G 3/20* (2006.01)
*G09G 3/36* (2006.01)

(52) U.S. Cl.
CPC ..... *G09G 3/2077* (2013.01); *G09G 3/3677* (2013.01); *G09G 2310/0278* (2013.01); *G09G 2310/066* (2013.01)

(58) Field of Classification Search
CPC ..... G09G 3/2077; G09G 3/3677; G09G 2310/0278; G09G 2310/066; G09G 3/20
See application file for complete search history.

(56) References Cited

U.S. PATENT DOCUMENTS

| | | | | |
|---|---|---|---|---|
| 9,842,527 | B2 * | 12/2017 | Morita | G09G 3/20 |
| 10,573,219 | B2 * | 2/2020 | Morita | G09G 3/2011 |
| 10,878,767 | B2 * | 12/2020 | Morita | G09G 3/3688 |
| 11,120,772 | B1 * | 9/2021 | Hsieh | H03F 3/45273 |
| 11,263,944 | B2 * | 3/2022 | Morita | G09G 3/20 |
| 2003/0001870 | A1 * | 1/2003 | Kageyama | G09G 3/3233 345/690 |
| 2003/0048248 | A1 * | 3/2003 | Fukumoto | G09G 3/3688 345/89 |
| 2003/0058229 | A1 * | 3/2003 | Kawabe | G09G 5/006 345/204 |
| 2003/0189541 | A1 * | 10/2003 | Hashimoto | G09G 3/3291 345/89 |

(Continued)

FOREIGN PATENT DOCUMENTS

| | | | |
|---|---|---|---|
| JP | 2005-181751 | A | 7/2005 |
| JP | 2007-219091 | A | 8/2007 |

(Continued)

*Primary Examiner* — Benyam Ketema
(74) *Attorney, Agent, or Firm* — Oliff PLC

(57) ABSTRACT

A circuit device includes a gradation voltage generation circuit, a correction processing circuit, and a driving circuit. The correction processing circuit performs correction processing on input display data to output corrected display data. The driving circuit drives an electro-optical panel by outputting gradation voltages corresponding to the corrected display data based on the gradation voltages. The gradation voltages are grouped into first to k-th groups. At this time, the correction processing circuit determines, by analyzing which group of the first to the k-th groups each input display data belongs to, a number of the input display data belonging to each group, and performs the correction processing based on the determined number.

12 Claims, 17 Drawing Sheets

(56) References Cited

U.S. PATENT DOCUMENTS

2003/0222840 A1* 12/2003 Koga ..... G09G 3/3607 345/89
2004/0179027 A1* 9/2004 Nakai ..... G09G 3/3696 345/690
2004/0212632 A1* 10/2004 Inada ..... G09G 3/3688 345/690
2005/0195145 A1* 9/2005 Maki ..... G09G 3/3688 345/89
2005/0231497 A1* 10/2005 Harada ..... G09G 3/3614 345/204
2005/0264548 A1* 12/2005 Okamura ..... G09G 3/3688 345/204
2006/0001627 A1* 1/2006 Murata ..... H03M 1/682 345/89
2006/0139273 A1* 6/2006 Harada ..... G09G 3/3614 345/89
2006/0279498 A1* 12/2006 Kaneda ..... G09G 3/3696 345/89
2007/0097060 A1* 5/2007 Takahashi ..... G09G 3/3614 345/98
2007/0115233 A1* 5/2007 Endo ..... G09G 3/3688 345/89
2007/0237407 A1* 10/2007 Hashido ..... G09G 3/3696 382/233
2008/0266231 A1* 10/2008 Umeda ..... G09G 3/3688 345/95
2009/0009537 A1* 1/2009 Shimatani ..... G09G 3/3696 345/690
2009/0146985 A1* 6/2009 Okada ..... G09G 3/2011 345/211
2010/0123738 A1* 5/2010 Matsukawa ..... G09G 3/3648 345/89
2014/0239846 A1* 8/2014 Shoji ..... H05B 45/60 315/297
2016/0111038 A1* 4/2016 Morita ..... G09G 3/2092 345/212
2016/0133218 A1* 5/2016 Morita ..... G09G 3/3696 345/99
2017/0272092 A1* 9/2017 Kim ..... H03M 1/66
2019/0043440 A1* 2/2019 Ishida ..... G09G 3/3688
2019/0088229 A1 3/2019 Morita
2019/0164466 A1* 5/2019 Sugihara ..... G09G 3/2011
2020/0005723 A1* 1/2020 Kim ..... G09G 3/3688
2020/0135119 A1* 4/2020 Nakayama ..... G09G 3/2003
2021/0407372 A1* 12/2021 Okuda ..... G09G 3/20

FOREIGN PATENT DOCUMENTS

JP 2016-90881 A 5/2016
JP 2019-56799 A 4/2019

* cited by examiner

NUMBER TABLE

| | PX1 | PX2 | PX3 | PX4 | PX5 | PX6 | PX7 | PX8 |
|---|---|---|---|---|---|---|---|---|
| KG8 | N81 | N82 | N83 | N84 | N85 | N86 | N87 | N88 |
| KG7 | N71 | N72 | N73 | N74 | N75 | N76 | N77 | N78 |
| KG6 | N61 | N62 | N63 | N64 | N65 | N66 | N67 | N68 |
| KG5 | N51 | N52 | N53 | N54 | N55 | N56 | N57 | N58 |
| KG4 | N41 | N42 | N43 | N44 | N45 | N46 | N47 | N48 |
| KG3 | N31 | N32 | N33 | N34 | N35 | N36 | N37 | N38 |
| KG2 | N21 | N22 | N23 | N24 | N25 | N26 | N27 | N28 |
| KG1 | N11 | N12 | N13 | N14 | N15 | N16 | N17 | N18 |

SORT IN DRIVING ORDER

| | Pre | Gs1 | Gs2 | Gs3 | Gs4 | Gs5 | Gs6 | Gs7 | Gs8 |
|---|---|---|---|---|---|---|---|---|---|
| | | PX6 | PX7 | PX8 | PX1 | PX2 | PX3 | PX4 | PX5 |
| KG8 | N80 | N86 | N87 | N88 | N81 | N82 | N83 | N84 | N85 |
| KG7 | N70 | N76 | N77 | N78 | N71 | N72 | N73 | N74 | N75 |
| KG6 | N60 | N66 | N67 | N68 | N61 | N62 | N63 | N64 | N65 |
| KG5 | N50 | N56 | N57 | N58 | N51 | N52 | N53 | N54 | N55 |
| KG4 | N40 | N46 | N47 | N48 | N41 | N42 | N43 | N44 | N45 |
| KG3 | N30 | N36 | N37 | N38 | N31 | N32 | N33 | N34 | N35 |
| KG2 | N20 | N26 | N27 | N28 | N21 | N22 | N23 | N24 | N25 |
| KG1 | N10 | N16 | N17 | N18 | N11 | N12 | N13 | N14 | N15 |

INCREASE NUMBER TABLE

| | Gs1 | Gs2 | Gs3 | Gs4 | Gs5 | Gs6 | Gs7 | Gs8 |
|---|---|---|---|---|---|---|---|---|
| KG8 | Z81 | Z82 | Z83 | Z84 | Z85 | Z86 | Z87 | Z88 |
| KG7 | Z71 | Z72 | Z73 | Z74 | Z75 | Z76 | Z77 | Z78 |
| KG6 | Z61 | Z62 | Z63 | Z64 | Z65 | Z66 | Z67 | Z68 |
| KG5 | Z51 | Z52 | Z53 | Z54 | Z55 | Z56 | Z57 | Z58 |
| KG4 | Z41 | Z42 | Z43 | Z44 | Z45 | Z46 | Z47 | Z48 |
| KG3 | Z31 | Z32 | Z33 | Z34 | Z35 | Z36 | Z37 | Z38 |
| KG2 | Z21 | Z22 | Z23 | Z24 | Z25 | Z26 | Z27 | Z28 |
| KG1 | Z11 | Z12 | Z13 | Z14 | Z15 | Z16 | Z17 | Z18 |

CORRECTION VALUE

| | Gs1 | Gs2 | Gs3 | Gs4 | Gs5 | Gs6 | Gs7 | Gs8 |
|---|---|---|---|---|---|---|---|---|
| KG8 | C81 | C82 | C83 | C84 | C85 | C86 | C87 | C88 |
| KG7 | C71 | C72 | C73 | C74 | C75 | C76 | C77 | C78 |
| KG6 | C61 | C62 | C63 | C64 | C65 | C66 | C67 | C68 |
| KG5 | C51 | C52 | C53 | C54 | C55 | C56 | C57 | C58 |
| KG4 | C41 | C42 | C43 | C44 | C45 | C46 | C47 | C48 |
| KG3 | C31 | C32 | C33 | C34 | C35 | C36 | C37 | C38 |
| KG2 | C21 | C22 | C23 | C24 | C25 | C26 | C27 | C28 |
| KG1 | C11 | C12 | C13 | C14 | C15 | C16 | C17 | C18 |

FIG. 8

| EXTERNAL POWER SUPPLY | GRADATION VOLTAGE | Input display data Dli [11:0] | | GROUP |
|---|---|---|---|---|
| | | HEXADECIMAL NUMBER | DECIMAL NUMBER | |
| PW9 | GV129 | | | |
| | ⋮ | FFFh | 4095 | KG8 |
| | ⋮ | ⋮ | ⋮ | |
| PW8 | GV113 | E00h | 3584 | |
| | ⋮ | DFFh | 3583 | KG7 |
| | ⋮ | ⋮ | ⋮ | |
| PW7 | GV97 | C00h | 3072 | |
| | ⋮ | BFFh | 3071 | KG6 |
| | ⋮ | ⋮ | ⋮ | |
| PW6 | GV81 | A00h | 2560 | |
| | ⋮ | 9FFh | 2559 | KG5 |
| | ⋮ | ⋮ | ⋮ | |
| PW5 | GV65 | 800h | 2048 | |
| | ⋮ | 7FFh | 2047 | KG4 |
| | ⋮ | ⋮ | ⋮ | |
| PW4 | GV49 | 600h | 1536 | |
| | ⋮ | 5FFh | 1535 | KG3 |
| | ⋮ | ⋮ | ⋮ | |
| PW3 | GV33 | 400h | 1024 | |
| | ⋮ | 3FFh | 1023 | KG2 |
| | ⋮ | ⋮ | ⋮ | |
| PW2 | GV17 | 200h | 512 | |
| | ⋮ | 1FFh | 511 | KG1 |
| | ⋮ | ⋮ | ⋮ | |
| PW1 | GV1 | 000h | 0 | |

FIG. 10

WITHOUT GL1 ROTATION

NUMBER TABLE

| | Pre | Gs1 | Gs2 | Gs3 | Gs4 | Gs5 | Gs6 | Gs7 | Gs8 |
|---|---|---|---|---|---|---|---|---|---|
| | | PX1 | PX2 | PX3 | PX4 | PX5 | PX6 | PX7 | PX8 |
| KG8 | 0 | 0 | 0 | 0 | 0 | 0 | 0 | 0 | 0 |
| KG7 | 0 | 0 | 0 | 0 | 0 | 0 | 0 | 0 | 0 |
| KG6 | 0 | 244 | 0 | 244 | 0 | 244 | 0 | 244 | 0 |
| KG5 | 0 | 0 | 0 | 0 | 0 | 0 | 0 | 0 | 0 |
| KG4 | 244 | 0 | 0 | 0 | 0 | 0 | 0 | 0 | 0 |
| KG3 | 0 | 0 | 0 | 0 | 0 | 0 | 0 | 0 | 0 |
| KG2 | 0 | 0 | 0 | 0 | 0 | 0 | 0 | 0 | 0 |
| KG1 | 0 | 0 | 244 | 0 | 244 | 0 | 244 | 0 | 244 |

INCREASE NUMBER TABLE

| | Gs1 | Gs2 | Gs3 | Gs4 | Gs5 | Gs6 | Gs7 | Gs8 |
|---|---|---|---|---|---|---|---|---|
| | PX1 | PX2 | PX3 | PX4 | PX5 | PX6 | PX7 | PX8 |
| KG8 | 0 | 0 | 0 | 0 | 0 | 0 | 0 | 0 |
| KG7 | 0 | 0 | 0 | 0 | 0 | 0 | 0 | 0 |
| KG6 | 244 | 0 | 244 | 0 | 244 | 0 | 244 | 0 |
| KG5 | 0 | 0 | 0 | 0 | 0 | 0 | 0 | 0 |
| KG4 | 0 | 0 | 0 | 0 | 0 | 0 | 0 | 0 |
| KG3 | 0 | 0 | 0 | 0 | 0 | 0 | 0 | 0 |
| KG2 | 0 | 0 | 0 | 0 | 0 | 0 | 0 | 0 |
| KG1 | 0 | 244 | 0 | 244 | 0 | 244 | 0 | 244 |

FIG. 13

WITHOUT GL3 ROTATION

NUMBER TABLE

| | Pre | Gs1 | Gs2 | Gs3 | Gs4 | Gs5 | Gs6 | Gs7 | Gs8 |
|---|---|---|---|---|---|---|---|---|---|
| | | PX1 | PX2 | PX3 | PX4 | PX5 | PX6 | PX7 | PX8 |
| KG8 | 0 | 0 | 0 | 0 | 0 | 0 | 0 | 0 | 0 |
| KG7 | 0 | 0 | 0 | 0 | 0 | 0 | 0 | 0 | 0 |
| KG6 | 0 | 84 | 0 | 84 | 0 | 84 | 0 | 84 | 0 |
| KG5 | 0 | 0 | 0 | 0 | 0 | 0 | 0 | 0 | 0 |
| KG4 | 244 | 0 | 0 | 0 | 0 | 0 | 0 | 0 | 0 |
| KG3 | 0 | 0 | 0 | 0 | 0 | 0 | 0 | 0 | 0 |
| KG2 | 0 | 0 | 0 | 0 | 0 | 0 | 0 | 0 | 0 |
| KG1 | 0 | 160 | 244 | 160 | 244 | 160 | 244 | 160 | 244 |

INCREASE NUMBER TABLE

| | Gs1 | Gs2 | Gs3 | Gs4 | Gs5 | Gs6 | Gs7 | Gs8 |
|---|---|---|---|---|---|---|---|---|
| | PX1 | PX2 | PX3 | PX4 | PX5 | PX6 | PX7 | PX8 |
| KG8 | 0 | 0 | 0 | 0 | 0 | 0 | 0 | 0 |
| KG7 | 0 | 0 | 0 | 0 | 0 | 0 | 0 | 0 |
| KG6 | 84 | 0 | 84 | 0 | 84 | 0 | 84 | 0 |
| KG5 | 0 | 0 | 0 | 0 | 0 | 0 | 0 | 0 |
| KG4 | 0 | 0 | 0 | 0 | 0 | 0 | 0 | 0 |
| KG3 | 0 | 0 | 0 | 0 | 0 | 0 | 0 | 0 |
| KG2 | 0 | 0 | 0 | 0 | 0 | 0 | 0 | 0 |
| KG1 | 160 | 84 | 0 | 84 | 0 | 84 | 0 | 84 |

FIG. 14

WITH GL3 ROTATION

NUMBER TABLE

| | Pre | Gs1 | Gs2 | Gs3 | Gs4 | Gs5 | Gs6 | Gs7 | Gs8 |
|---|---|---|---|---|---|---|---|---|---|
| | | PX6 | PX7 | PX8 | PX1 | PX2 | PX3 | PX4 | PX5 |
| KG8 | 0 | 0 | 0 | 0 | 0 | 0 | 0 | 0 | 0 |
| KG7 | 0 | 0 | 0 | 0 | 0 | 0 | 0 | 0 | 0 |
| KG6 | 0 | 0 | 84 | 0 | 84 | 0 | 84 | 0 | 84 |
| KG5 | 0 | 0 | 0 | 0 | 0 | 0 | 0 | 0 | 0 |
| KG4 | 244 | 0 | 0 | 0 | 0 | 0 | 0 | 0 | 0 |
| KG3 | 0 | 0 | 0 | 0 | 0 | 0 | 0 | 0 | 0 |
| KG2 | 0 | 0 | 0 | 0 | 0 | 0 | 0 | 0 | 0 |
| KG1 | 0 | 244 | 160 | 244 | 160 | 244 | 160 | 244 | 160 |

INCREASE NUMBER TABLE

| | Gs1 | Gs2 | Gs3 | Gs4 | Gs5 | Gs6 | Gs7 | Gs8 |
|---|---|---|---|---|---|---|---|---|
| | PX6 | PX7 | PX8 | PX1 | PX2 | PX3 | PX4 | PX5 |
| KG8 | 0 | 0 | 0 | 0 | 0 | 0 | 0 | 0 |
| KG7 | 0 | 0 | 0 | 0 | 0 | 0 | 0 | 0 |
| KG6 | 0 | 84 | 0 | 84 | 0 | 84 | 0 | 84 |
| KG5 | 0 | 0 | 0 | 0 | 0 | 0 | 0 | 0 |
| KG4 | 0 | 0 | 0 | 0 | 0 | 0 | 0 | 0 |
| KG3 | 0 | 0 | 0 | 0 | 0 | 0 | 0 | 0 |
| KG2 | 0 | 0 | 0 | 0 | 0 | 0 | 0 | 0 |
| KG1 | 244 | 0 | 84 | 0 | 84 | 0 | 84 | 0 |

FIG. 15

CIRCUIT DEVICE, ELECTRO-OPTICAL DEVICE, AND ELECTRONIC APPARATUS

The present application is based on, and claims priority from JP Application Serial Number 2020-109418, filed Jun. 25, 2020, the disclosure of which is hereby incorporated by reference herein in its entirety.

BACKGROUND

1. Technical Field

The present disclosure relates to a circuit device, an electro-optical device, and an electronic apparatus.

2. Related Art

JP-A-2016-90881 describes a display driver that includes a reference voltage generation circuit, a D/A converter circuit, and a voltage driving circuit. The reference voltage generation circuit is a ladder resistance that outputs a plurality of gradation voltages by resistance-division. The D/A converter circuit selects, from among the plurality of gradation voltages, a gradation voltage corresponding to display data. The voltage driving circuit drives a data line of an electro-optical panel by outputting a data voltage based on the selected gradation voltage. A plurality of the D/A converter circuits and the voltage driving circuits are provided, where each D/A converter circuit selects a gradation voltage corresponding to the input display data.

With the display driver described above, a reference voltage generation circuit outputs a plurality of the gradation voltages to a plurality of output lines, and the plurality of D/A converter circuits are commonly coupled to each output line. Thus, when many D/A converter circuits select the same gradation voltage, input nodes of many voltage driving circuits will be coupled to the output line of that gradation voltage. As a result, the load of the output line increases, which leads to a problem in that the gradation voltage fluctuates, whereby the fluctuation in the gradation voltage cause an error in the data voltage.

SUMMARY

One aspect of the present disclosure relates to a circuit device, including a gradation voltage generation circuit configured to generate first to m-th gradation voltages, m being an integer of 3 or greater, a correction processing circuit configured to, by performing correction processing on i-th input display data of first to n-th input display data, output i-th corrected display data of first to n-th corrected display data, i being an integer of 1 to n, n being an integer of 3 or greater, and first to n-th driving circuits configured to drive an electro-optical panel by an i-th driving circuit thereof outputting, based on the first to m-th gradation voltages, a gradation voltage corresponding to the i-th corrected display data, wherein when the first to m-th gradation voltages are grouped into first to k-th groups with k being an integer of 2 or greater and less than m, the correction processing circuit is configured to, by analyzing which group of the first to k-th groups each input display data of the first to n-th input display data belong to, determine a number of the input display data belonging to each group of the first to k-th groups, and perform the correction processing based on the determined number.

Another aspect of the present disclosure relates to an electro-optical device including the circuit device and the electro-optic panel described above.

Still another aspect of the present disclosure relates to an electronic apparatus including the circuit device described above.

BRIEF DESCRIPTION OF THE DRAWINGS

FIG. 8 is a diagram illustrating correction processing performed by the correction processing circuit.

FIG. 10 is a diagram illustrating a relationship between input display data and a group.

FIG. 13 is a number table and an increase number table upon driving pixels of a scanning line GL1.

FIG. 14 is a number table and an increase number table upon driving pixels of a scanning line GL3.

FIG. 15 is a number table and an increase number table in a case where rotation is performed.

DESCRIPTION OF EXEMPLARY EMBODIMENTS

Exemplary embodiments of the present disclosure will be described in detail hereinafter. Note that the exemplary embodiments described hereinafter are not intended to unjustly limit the content of the present disclosure as set forth in the claims, and all of the configurations described in the exemplary embodiments are not always required to solve the issues described in the present disclosure.

1. Circuit Device

Figure 1:
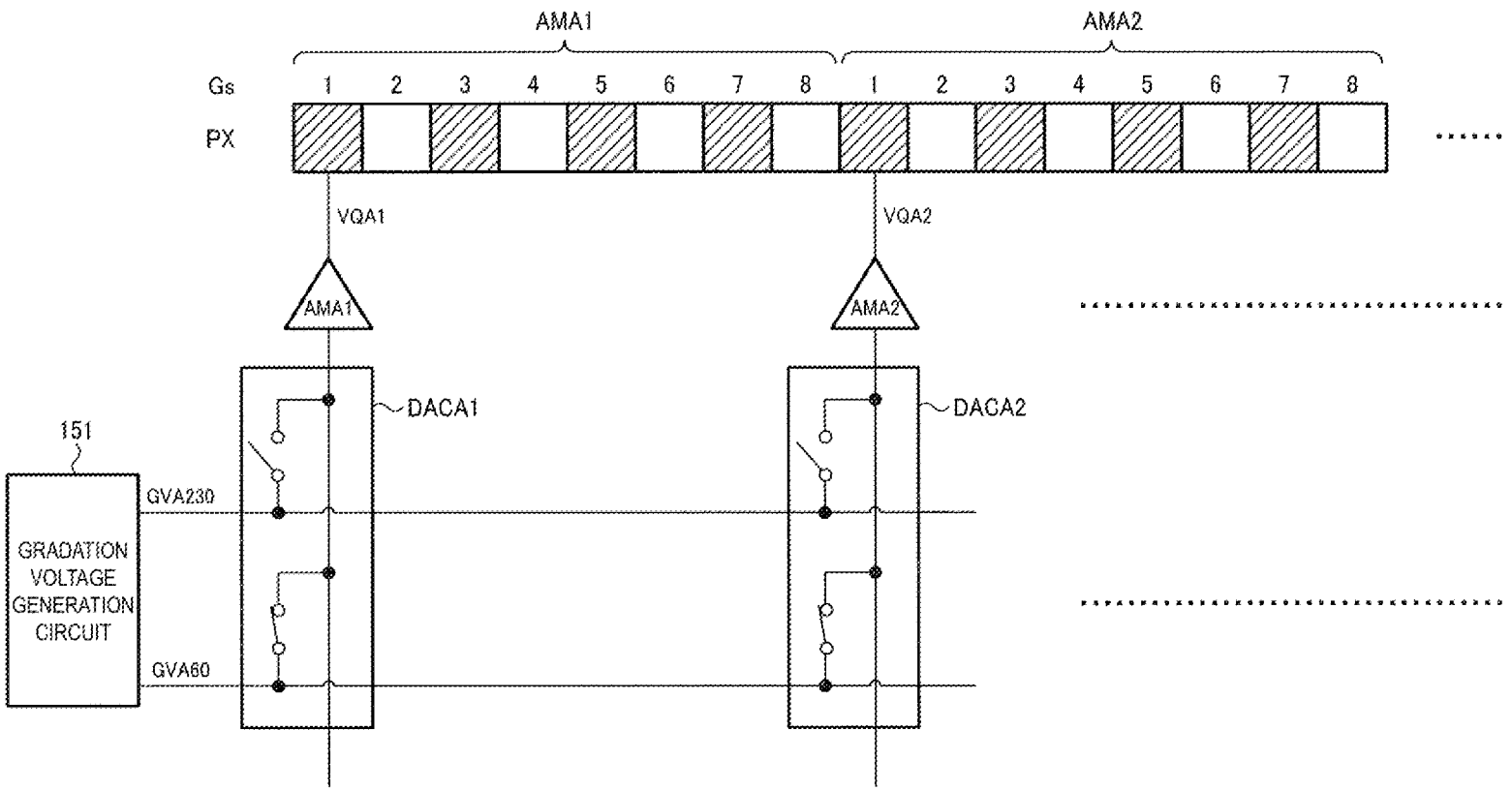
FIG. 1 is a schematic diagram illustrating pixels of a single scanning line to be demultiplex-driven.
Figure 2:
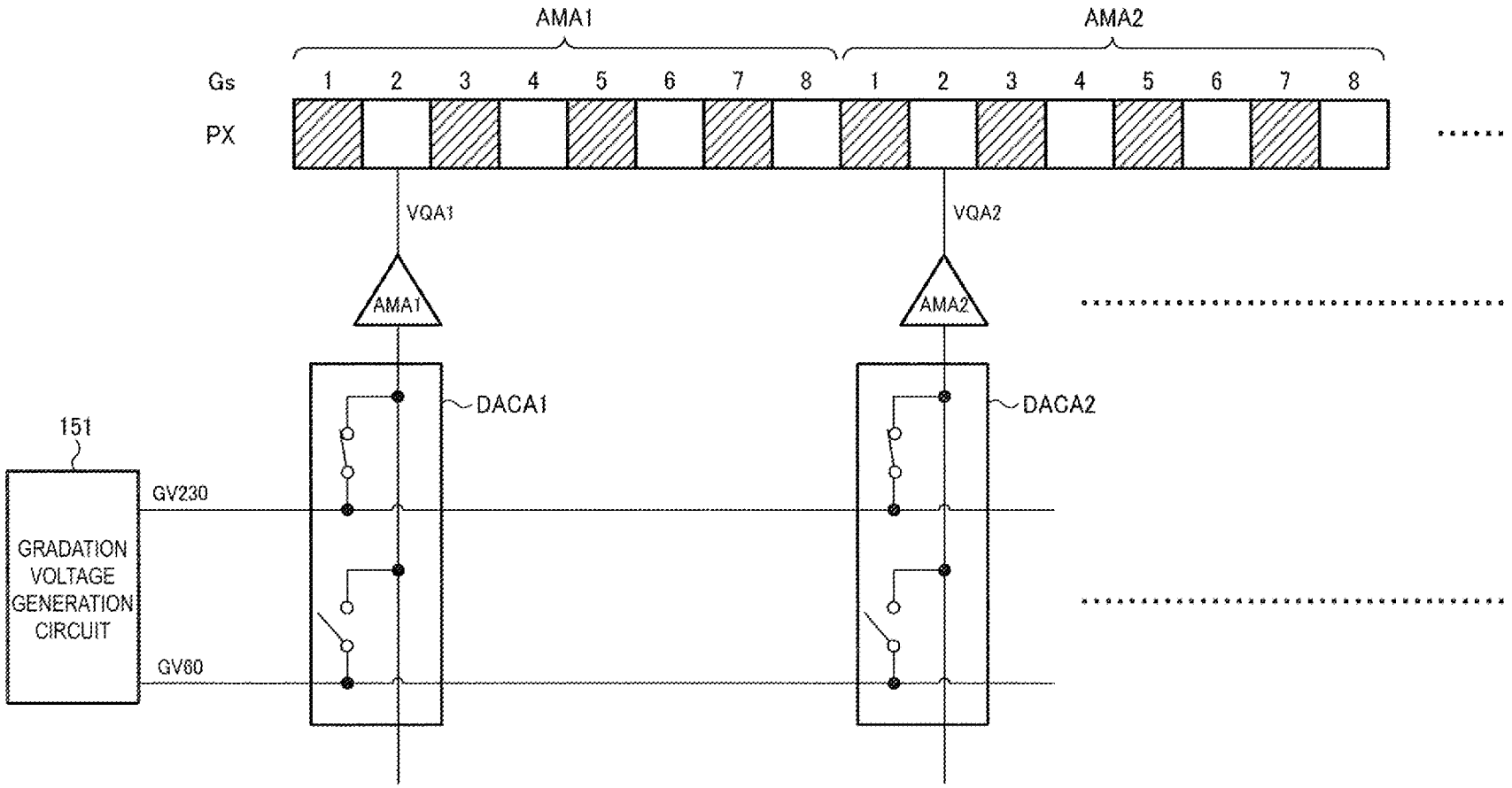
FIG. 2 is a schematic diagram illustrating the pixels of the single scanning line to be demultiplex-driven.
Figure 3:
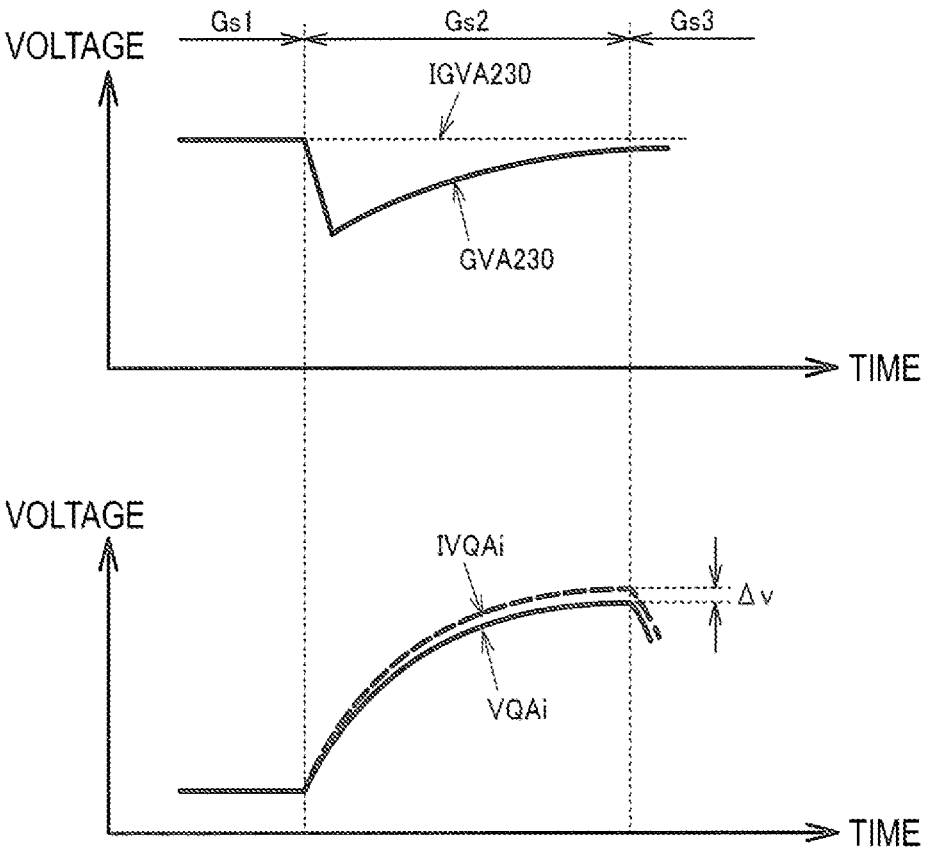
FIG. 3 is an example of a data voltage output by an amplifier circuit.

First, problems of a comparative technique will be described using FIGS. 1 to 3. FIG. 1 and FIG. 2 illustrate pixels PX for a single scanning line to be demultiplex-driven in driving periods Gs1 to Gs8. Displaying is performed with 256gradations, and gradation voltages are set to from GVA1 to GVA256. A hatched pixel of the pixels PX is a pixel that is relatively darker than an unhatched pixel. A gradation voltage GVA60 is written to the hatched pixel. A gradation voltage GVA230 is written to the unhatched pixel of the pixels PX.

A gradation voltage generation circuit 151 outputs the gradation voltages GVA1 to GVA256. Here, only the gradation voltages GVA60 and GVA230 are illustrated. As illustrated in FIG. 1, during the driving period Gs1, D/A converter circuits DACA1 and DACA2 connect output lines of the gradation voltage GVA60 and input nodes of amplifier circuits AMA1, AMA2. The amplifier circuits AMA1 and AMA2 output the gradation voltage GVA60 as data voltages VQA1, VQA2. As illustrated in FIG. 2, during the next driving period Gs2 that is subsequent to the driving period Gs1, the D/A converter circuits DACA1 and DACA2 connect the output lines of the gradation voltage GVA230 and the input nodes of the amplifier circuits AMA1, AMA2. The amplifier circuits AMA1 and AMA2 output the gradation voltage GVA230 as the data voltages VQA1, VQA2. That is, during the driving period Gs1, parasitic capacitances of the input nodes of the amplifier circuits AMA1, AMA2 are charged by the gradation voltage GVA60, and when switching to the driving period Gs2, the input nodes are coupled to the output lines of the gradation voltage GVA230.

Although only the pixels driven by the two amplifier circuits are illustrated in FIGS. 1 and 2, the actual display driver is provided with a number of 10 to 100 amplifier circuits. Thus, as illustrated in FIG. 3, when switching from the driving period Gs1 through Gs2, the input nodes of a large number of the amplifier circuits charged to the gradation voltage GVA60 are coupled to the output lines of the gradation voltage GVA230, by which the voltage of the output lines will fluctuate. During the driving period Gs2, a number of the amplifier circuits coupled to the output lines of the gradation voltage GVA230 varies depending on a display image, but the greater the number, the greater the fluctuation in the gradation voltage GVA230. There is a problem that, when the fluctuation in the gradation voltage GVA230 is greater, the gradation voltage GVA230 also has an error with respect to an ideal value even at the end of pixel writing during the driving period Gs2, and thus the foregoing error causes additional errors in the data voltages VQA1, VQA2. FIG. 3 illustrates an example of the data voltage VQA1 output by the amplifier circuit AMA1, wherein an ideal data voltage in a case where the gradation voltage GVA230 does not fluctuate is illustrated as IVQA1. Av indicates a voltage error at the end of the driving period Gs2.

Figure 4:
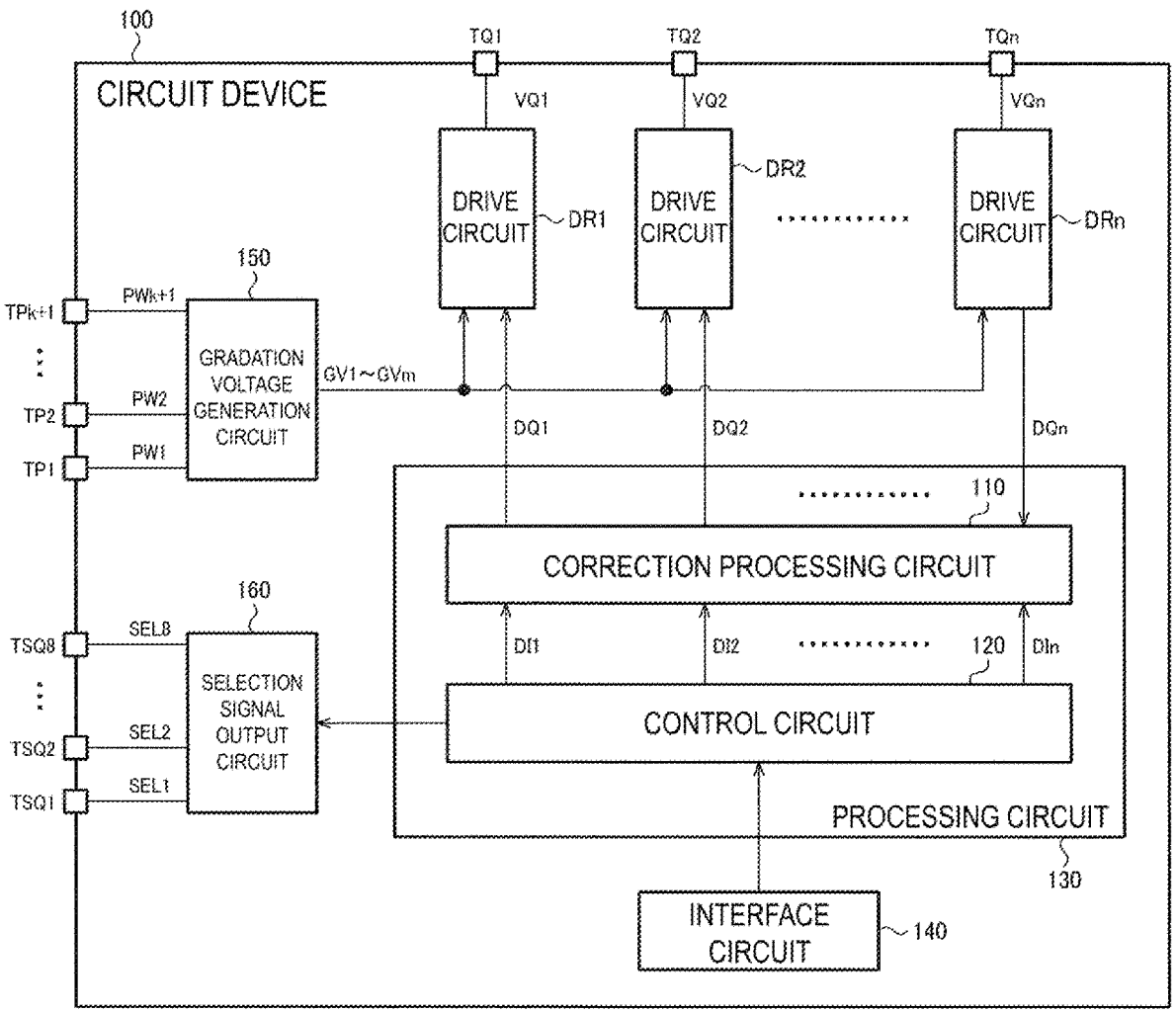
FIG. 4 is an example of a configuration of a circuit device in an exemplary embodiment.

FIG. 4 is an example of a configuration of a circuit device 100 in an exemplary embodiment. The circuit device 100 includes a processing circuit 130, an interface circuit 140, a gradation voltage generation circuit 150, a selection signal output circuit 160, driving circuits DR1 to DRn corresponding to first to n-th driving circuits, selection signal output terminals TSQ1 to TSQ8, data signal output terminals TQ1 to TQn, and external power supply input terminals TP1 to TPk+1 corresponding to first to k+1-th external power supply input terminals. n is an integer of 3 or greater, and k is an integer of 1 or greater. Note that hereinafter, the number of demultiplexes in the demultiplex-driving is 8, while the number of demultiplexes may be any number greater than or equal to two.

The circuit device 100 is a display driver that drives an electro-optical panel. The circuit device 100 is, for example, an integrated circuit device manufactured by a semiconductor process. The integrated circuit device is also referred to as an IC, and is a semiconductor chip in which circuit elements are formed at a semiconductor substrate. The selection signal output terminals TSQ1 to TSQ8 and the data signal output terminals TQ1 to TQn and the external power supply input terminals TP1 to TPk+1 are terminals of the integrated circuit device, and are pads formed at, for example, a semiconductor chip.

The interface circuit 140 receives display data and a display control signal from an external processing device, such as a display controller. The display control signal is a clock signal, a synchronization signal, etc. Various image data interfaces such as an RGB interface scheme or a LVDS (Low Voltage Differential Signal) scheme are employed as the interface circuit 140.

The processing circuit 130 performs display control based on the display data and the display control signal received by the interface circuit 140. Specifically, the processing circuit 130 includes a control circuit 120 and a correction processing circuit 110. The control circuit 120 controls the demultiplex-driving by causing the selection signal output circuit 160 to output selection signals SEL1 to SEL8 based on the display control signal. Further, the control circuit 120 outputs input display data DI' to DIn corresponding to first to n-th input display data, based on the display data. The correction processing circuit 110 performs correction processing on the input display data DI' to DIn, and outputs corrected display data DQ1 to DQn corresponding to first to n-th corrected display data, to the driving circuits DR1 to DRn. The correction processing circuit 110 corrects the voltage error Av in FIG. 3 by correcting the display data in accordance with how many gradation voltages belonging to each group are selected when the gradation voltages GV1 to GVm are divided into a plurality of groups. The details of this correction processing will be described later. The processing circuit 130 is a logic circuit, and is, for example, a gate array configured by automatic layout wiring, a standard cell array configured by automatic wiring, etc. Note that the processing circuit 130 and some or all of the interface circuit 140 and some or all of the selection signal output circuit 160 may be configured as an integrated gate array or a standard cell array.

The selection signal output circuit 160 outputs the selection signals SEL1 to SEL8 to the electro-optical panel from the selection signal output terminals TSQ1 to TSQ8 based on control from the control circuit 120. The selection signal output circuit 160 is, for example, a buffer circuit.

The gradation voltage generation circuit 150 generates the gradation voltages GV1 to GVm based on the external power supply voltages PW1 to PWk+1 input to the external power supply input terminals TP1 to TPk+1 from an external power supply circuit, etc. m is an integer of 1 or greater. The gradation voltage generation circuit 150 is a ladder resistance circuit as described below.

i is an integer of 1 to n. A driving circuit DRi selects, among the gradation voltages GV1 to GVm, a gradation voltage corresponding to corrected display data DQi, and outputs a data voltage VQi from a data signal output terminal TQi by buffering or amplifying the selected gradation voltage. As described below, the driving circuit DRi includes a D/A converter circuit and an amplifier circuit.

Figure 5:
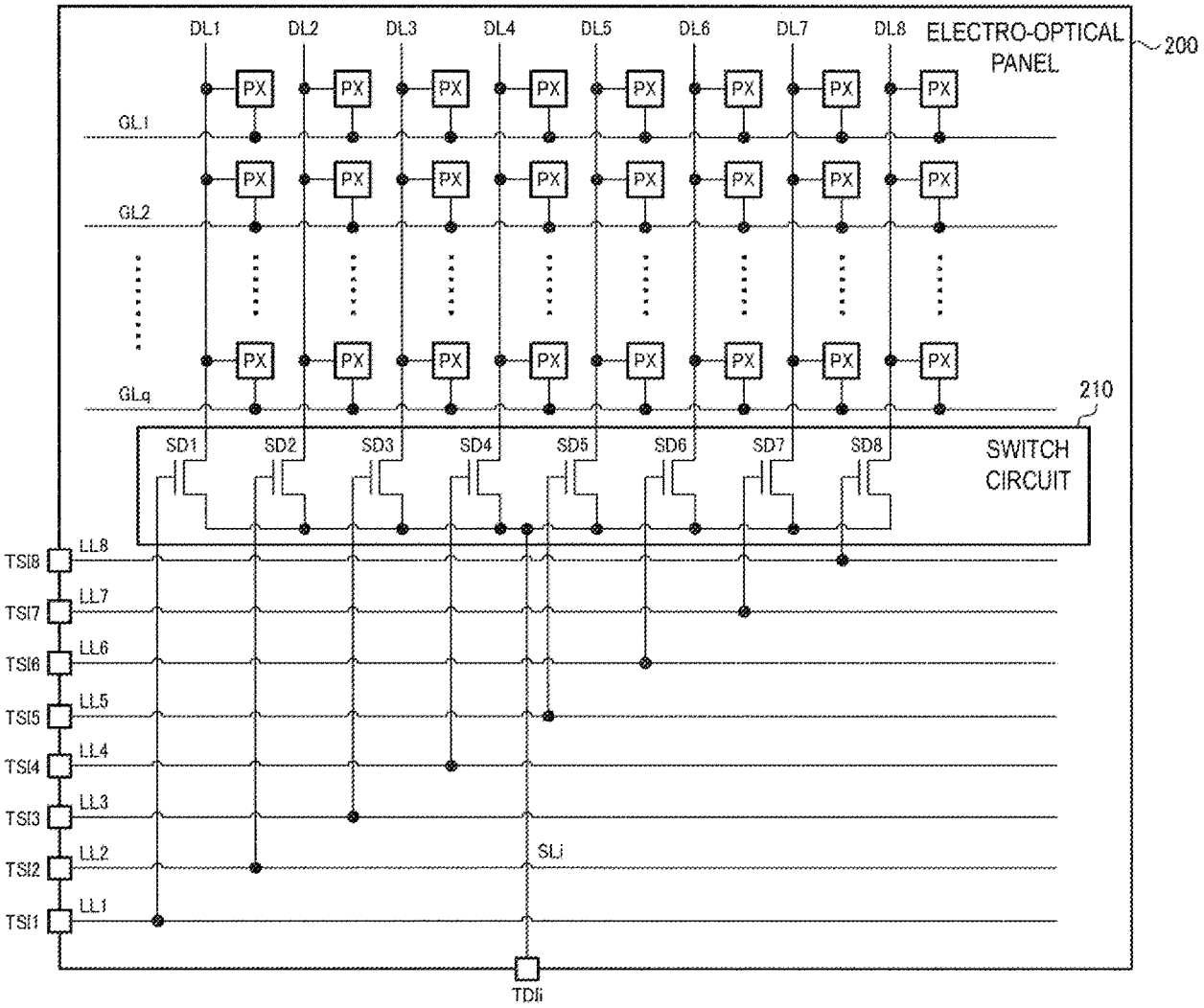
FIG. 5 is an example configuration of an electro-optical panel driven by the circuit device.

FIG. 5 illustrates an example configuration of an electro-optical panel 200 driven by the circuit device 100. Here, a portion driven by the drive circuit DRi is illustrated, and the electro-optical panel 200 is provided with a similar configuration corresponding to each of the driving circuits.

The electro-optical panel 200 is, for example, a liquid crystal display panel, an EL (Electro Luminescence) panel, etc. The electro-optical panel 200 includes a data signal input terminal TDIi, a data signal supply line SLi, selection signal input terminals TSI1 to TSI8, selection signal lines LL1 to LL4, a switch circuit 210, data lines DL1 to DL8, scanning lines GL1 to GLq, and a plurality of pixels PX. q is an integer equal to or greater than 2.

The selection signal input terminals TSI1 to TSI8 are coupled to selection signal output terminals TSQ1 to TSQ8 of the circuit device 100. One ends of the selection signal lines LL1 to LL8 are coupled to selection signal input terminals TSI1 to TSI8. The data signal input terminal TDIi is coupled to the data signal output terminal TQi of the circuit device 100. One end of the data signal supply line SLi is coupled to the data signal input terminal TDIi.

The switch circuit 210 includes transistors SD1 to SD8. The transistors SD1 to SD8 are N-type transistors configured with TFTs (Thin Film Transistors), for example. Drains of the transistors SD1 to SD8 are commonly coupled to the other end of the data signal supply line SLi. Sources of the transistors SD1 to SD8 are coupled to one ends of the data lines DL1 to DL8. Gates of the transistors SD1 to SD8 are coupled to selection signal lines LL1 to LL8.

The pixels PX are provided at each intersection point between the data lines DL1 to DL8 and the scanning lines GL1 to GLq. In other words, one data line of the data lines DL1 to DL8 and one scanning signal line of the scanning lines GL1 to GLq are coupled to one of the pixels PX. Note that the electro-optical panel 200 may include a scanning driver (not illustrated) that outputs a scanning signal to the scanning lines GL1 to GLq. Alternatively, the scanning driver may be provided at the circuit device 100.

The demultiplxer driving in a single horizontal scanning period will be described. Here, it is assumed that the scanning line GL1 is selected.

During the pre-charge period, the processing circuit 130 all sets selection signals SEL1 to SEL8 to the high level, and all of the transistors SD1 to SD8 are on. The processing circuit 130 outputs the corrected display data DQi corresponding to a pre-charge voltage, and the driving circuit DRi outputs the pre-charge voltage. As a result, the data lines DL1 to DL8 and the pixels PX coupled to the scanning line GL1 are pre-charged.

The driving periods of the pixels are set to Gs1 to Gs8. An example in which the data lines DL1 to DL8 are sequentially driven will be described, however, the driving order of the data lines DL1 to DL1 may be arbitrary. The data voltages written to the pixels PX coupled to the data lines DL1 to DL8 correspond to eighth data voltages. During the driving period Gs1, the processing circuit 130 sets the selection signal SELL to the high level, and sets the selection signals SEL2 to SEL8 to the low level. The transistor SD1 is turned on, and the transistors SD2 to SD8 are turned off. The processing circuit 130 outputs the corrected display data DQi corresponding to the first data voltage, and the driving circuit DRi outputs the first data voltage. As a result, the first data voltage is written to the pixel PX coupled to the data line DL1 and the scanning line GL1. Similarly, during the driving periods Gs2 to Gs8, the processing circuit 130 sequentially sets the selection signals SEL2 to SEL8 to the high level, and the driving circuit DRi outputs the second to eighth data voltages. As a result, the second to eighth data voltages are written to the pixels PX coupled to the data lines DL2 to DL8 and the scanning line GL1.

Figure 6:
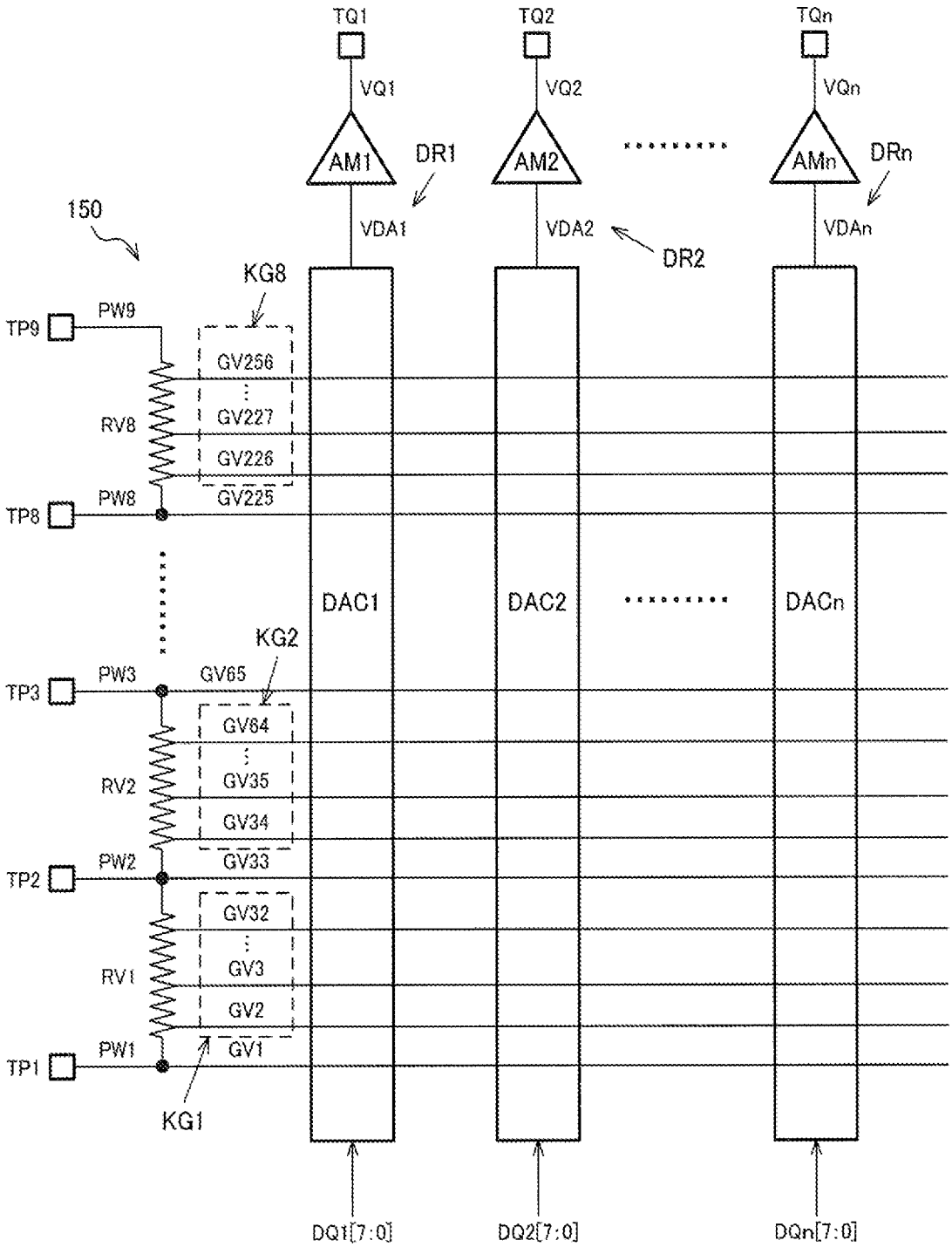
FIG. 6 is a first detailed configuration example of a gradation voltage generation circuit and a driving circuit.

FIG. 6 is a first detailed configuration example of the gradation voltage generation circuit 150 and the driving circuits DR1 to DRn. Here, it is assumed that k=8, m=256, and the display data is 8 bits.

The gradation voltage generation circuit 150 is a ladder resistance circuit in which resistors RV1 to RV8 are connected in series. One end of the resistor RV1 is coupled to the external power supply input terminal TP1, and the other end is coupled to the external power supply input terminal TP2. Similarly, one ends of the resistors RV2 to RV8 are coupled to the external power supply input terminals TP2 to TP8, and the other ends are coupled to the external power supply input terminals TP3 to TP9. Although not illustrated in FIG. 6, each of the resistors RV1 to RV1 is a ladder resistance, and the gradation voltage is output by dividing the external power supply voltage.

Specifically, the external power supply voltages PW1, PW2, . . . , PW8 input to the external power supply input terminals TP1, TP2, . . . , TP8 correspond to the gradation voltages GV1, GV33, . . . , GV225, respectively. The resistor RV1 outputs the gradation voltages GV2 to GV32 by dividing between PW1=GV1 and PW2=GV33. The gradation voltages GV2 to GV32 between the PW1 and the PW2 correspond to a first group KG1. Similarly, the resistors RV2, . . . , RV8 output the gradation voltages GV34 to GV64, . . . , GV226 to GV256. The gradation voltages GV34 to GV64, . . . , GV226 to GV256 correspond to a second group KG2, . . . , and an eighth group KG8. Such grouping is used in the correction processing described below.

The driving circuit DR1 includes a D/A converter circuit DAC1 and an amplifier circuit AM1. Similarly, the driving circuits DR2 to DRn include D/A converter circuits DAC2 to DACn and amplifier circuits AM2 to AMn. Hereinafter, the operation of the driving circuit DR1 will be described as an example, while the operations of the driving circuits DR2 to DRn are the same.

The D/A converter circuit DAC1 performs D/A conversion on the corrected display data DQ1 [7:0]. The D/A converter circuit DAC1 is a voltage selection circuit configured by an analog switch. When DQ1 [7:0]=0d, the D/A converter circuit DAC1 selects the gradation voltage GV1, and outputs the gradation voltage GV1 as a voltage VDA1. d means a decimal number. Similarly, when DQ1 [7:0]=1d to 255*d*, the D/A converter circuit DAC1 selects the gradation voltages GV2 to GV256, and outputs the gradation voltages GV2 to GV256 as the voltage VDA1. Note that DQ1 [7:0]=1d to 31*d*, 33*d* to 63d, . . . , 225*d* to 255*d* correspond to the groups KG1, KG2, . . . , and KG8 described above.

The amplifier circuit AM1 outputs a data voltage VQ1 by buffering or amplifying the voltage VDA1 from the D/A converter circuit DAC1. The amplifier circuit AM1 is, for example, a voltage follower circuit in which an inverting input is coupled to an output of an operational amplifier, and the voltage VDA1 is input to a non-inverting input of the operational amplifier. Alternatively, the amplifier circuit AM1 may be a forward amplification circuit or an inverting amplifier circuit configured by an operational amplifier and a resistor, etc.

Figure 7:
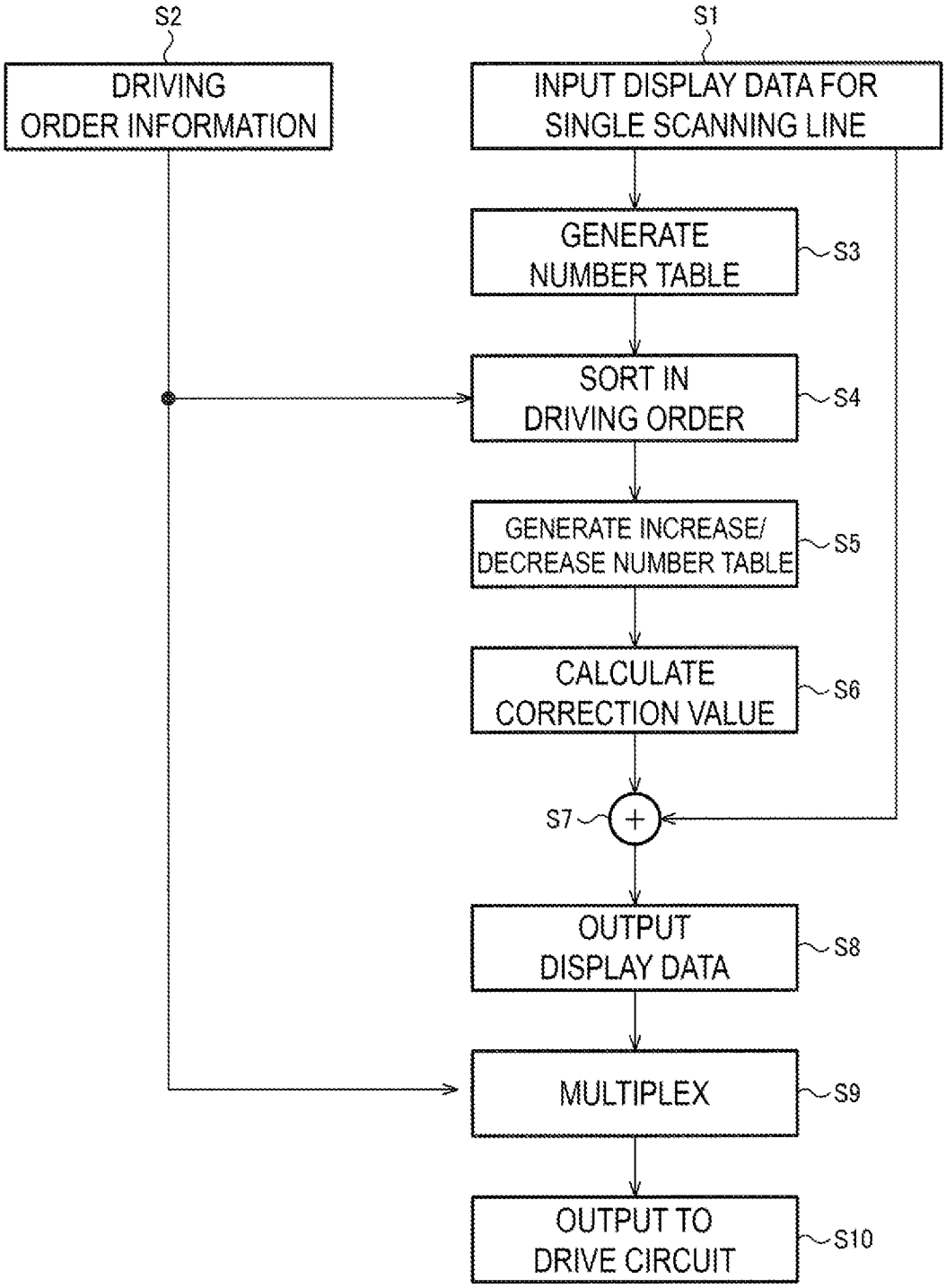
FIG. 7 is a flowchart of processing performed by a processing circuit.

FIG. 7 is a flowchart of processing performed by the processing circuit 130. FIG. 8 is a diagram illustrating the correction processing performed by the correction processing circuit 110.

In steps S1 and S2, the control circuit 120 outputs the input display data for a single scanning line and driving order information in the single scanning line to the correction processing circuit 110. In step S3, the correction processing circuit 110 generates a number table based on input display data for the single scanning line.

The number table is illustrated on the top row of FIG. 8. It is assumed that PX1 to PX8 are pixels driven by each of the driving circuits in the single horizontal scanning period, and are arranged in a horizontal scanning direction in that order. When α, β are integers of 1 to 8, Nα|3 is a number of the driving circuits that select a gradation voltage belonging to a group KGα when driving a pixel PXβ. For example, N11 is a number of driving circuits that select a gradation voltage belonging to a group KG1, among the driving circuits DR1 to DRn. The correction processing circuit 110 counts the number based on the input display data. The input display data is arranged in order of pixel data of pixels PX1, PX2, . . . , PX8 driven by the driving circuit DR1, pixel data of pixels PX1, PX2, . . . , PX8 driven by the driving circuit DR2, . . . , and pixel data of pixels PX1, PX2, . . . , PX8 driven by the driving circuit DRn. The correction processing circuit 110 determines to which group the pixel data to be input in that order belongs, counts the Nαβ, and then terminates the generation of the number table of the single scanning line when the input display data for the single scanning line is terminated.

In step S4, the correction processing circuit 110 sorts the number table in driving order based on the driving order information. In step S5, the correction processing circuit 110 generates an increase/decrease table from the number table sorted in the driving order. In step S6, the correction processing circuit 110 determines the correction value from the increase/decrease table.

The number table divided sorted in the driving order is illustrated in the upper middle of FIG. 8. Here, it is assumed that the pixels PX6, PX7, PX8, PX1, PX2, PX3, PX4, PX5 are driven in this order during the driving periods Gs1 to Gs8. The correction processing circuit 110 rearranges the number table according to this driving order. Pre indicates the pre-charge period, and Nα0 is a number of the driving circuits that select the gradation voltage belonging to the group KGα during pre-charging. The pre-charge voltage is predetermined, and correspondingly, the pre-charge voltage is determined in advance. Note that, in a case where the pre-charge period is not considered, the Nα0 may be 0.

An increase number table is illustrated in the middle bottom row of FIG. 8. When γ is an integer of 1 to 8, Zαγ is an increase number from a number of groups KGα in the previous driving period Gs(γ−1) to a number of groups KGα in the current driving period Gsγ. Taking Z12 as an example, Z12=N17−N16 when N17−N16≥0, and Z12=0 when N17−N16<0. Note that Gs0 indicates the pre-charge period.

A correction value table is illustrated in the bottom row of FIG. 8. Cay is a correction value used when the input display data of the pixels driven at the driving period Gsγ belongs to the group KGα. The correction processing circuit 110 computes the correction value Cay based on the increase number Zαγ. Specifically, the correction processing circuit 110 increases the correction value Cay as the increase number Zαγ increases. More specifically, the correction processing circuit 110 computes the correction value Cay according to Equation (1) below. Prm is a coefficient. In a case where the polarity inversion driving is performed, the coefficient Prm may vary depending on the drive polarity. Moreover, the coefficient Prm may be different for each driving period. For example, a coefficient Prm of Gs1 and a coefficient Prm of Gs2 may be different. Dir indicates orientation and is Dir=+1 or −1. The Dir means a gradation fluctuation direction from the previous driving period to the current driving period. That is, when the selective gradation of a certain driving circuit fluctuates from a low gradation to a high gradation, Dir=+1, and when the selective gradation fluctuates from a high gradation to a low gradation, Dir=−1. In Equation (1) below, a case in which the Dir is +1 or −1 is described, but the ZayxPrmxDir is determined and added to each of the Dir=+1 and −1.

$$C\alpha\gamma = Z\alpha\gamma \times Prm \times Dir \quad (1)$$

In steps S7 and S8, the correction processing circuit 110 generates the corrected display data by adding the correction value to the input display data. In other words, the correction processing circuit 110 adds the correction value Cay to the input display data when the input display data of the pixels driven at the driving period Gsγ belongs to the group KGα. In steps S9 and S10, the processing circuit 130 multiplexes the corrected display data based on the driving order information, and then outputs the corrected display data to the driving circuit.

According to the above-described exemplary embodiment, the gradation voltages GV1 to GV256 are grouped into the groups KG1 to KG8. At this time, the correction processing circuit 110 determines, by analyzing which group of the groups KG1 to KG8 each input display data of the input display data DI' to DIn belong to, a number of the input display data Nαβ, belonging to each group, and performs the correction processing on the input display data DI1 to DIn based on the number Nαβ.

In this manner, the number of driving circuits that have selected the gradation voltages belonging to each group (i.e., the number of amplifier circuits coupled to the output lines of the gradation voltages belonging to each group) is determined, whereby the input display data is corrected in accordance with the number thereof. As described in FIGS. 1 to 3, the data voltage errors differ depending on the number of the amplifier circuits coupled to the output lines of the gradation voltages. However, according to the present exemplary embodiment, by correcting on the data side in accordance with the number thereof, the data voltage errors can be brought close to an ideal value. Additionally, by dividing the gradation voltages into the groups 1 to 4, computational load of the correction processing can be reduced. In other words, the number table, etc. as illustrated in FIG. 8 needs to be determined upon performing the correction, but the number of elements in the table is reduced by grouping, and thus the computational load is reduced.

Further, in the present exemplary embodiment, the circuit device 100 includes the external power supply input terminals TP1 to TP1, to which the external power supply voltages PW1 to PW1 are input. The gradation voltage generation circuit 150 generates a gradation voltage of a p-th group KGp by performing resistance-division between a p-th external power supply voltage PWp and a p+1-th external power supply voltage PWp+1.

The gradation voltages GV1, GV33, . . . , GV225 corresponding to the external power supply voltages are considered to have small voltage fluctuations even when the load is large. On the other hand, the gradation voltages GV2 to GV32, GV34 to GV64, . . . , GV226 to GV256 are coupled to an external power source via a resistor, so when the load is large, voltage fluctuations occur. In the present exemplary embodiment, by grouping the gradation voltages with which the resistance-divided is performed between the external power supply voltages, the data voltage errors due to the fluctuations in the gradation voltages are corrected.

In the present exemplary embodiment, the correction processing circuit 110 performs the correction processing so that a gradation value of the input display data belonging to the p-th group KGp does not exceed a gradation value corresponding to the p-th external power supply voltage PWp and the p+1-th external power supply voltage PWp+1.

Gradation values of 33 to 63 corresponding to the gradation voltages GV34 to GV64 of the group KG2 are taken as an example. Gradation values 32, 65 correspond to the external power supply voltages PW2 and PW3, while the correction processing circuit 110 performs the correction processing so that the gradation value after the correction to be in a range of 32 to 65. For example, when the gradation value of the input display data is 60, the correction processing circuit 110 corrects the gradation value of the input display data to 65, even in a case where the correction processing circuit 110 determines+7 as an initial correction value.

For example, even when the gradation voltage GV61 fluctuates towards higher, the gradation voltage GV65 corresponding to the external power supply voltage PW3 is approximately fixed. Therefore, it is considered that the correction may be performed in a range equal to or less than the gradation voltage GV65. In the present exemplary embodiment, the input display data is corrected so as not to exceed the gradation values corresponding to the external power supply voltages, and thus no correction is performed beyond the external power supply voltages. In addition, when the correction over the group is performed, the number of selected groups is changed to force the number table to be calculated again from the result, while in the present exemplary embodiment, the correction over the group is not performed.

Further, in the present exemplary embodiment, the correction processing circuit 110 performs the correction processing on the input display data belonging to, among the groups KG1 to KG8, a group for which the number determined by the current analysis is greater than the number determined by the previous analysis by a prescribed value or more.

The "current time" is a driving period that is the operation of interest, and the "previous time" is a driving period immediately before the "current time". In FIG. 8, for example, when taking the increase number Z22 as an example, "the number determined by the analysis at a previous time" is N26, and "the number determined by the analysis at a current time" is N27. When Z22=N27−N26>Nthr, the correction processing circuit 110 performs the correction processing using the correction value C22. The Nthr is the prescribed value. For example, the correction processing circuit 110 sets C22=0 regardless of the value of Z22 when Z22=N27−N26<Nthr, and determines C22 based on Z22 when Z22=N27−N26≥Nthr.

The gradation voltages, which belong to a group with a small increase number, have a small voltage fluctuation due to a small load, and thus the effect on the data voltages thereof may be ignored. According to the present exemplary embodiment, the gradation value belonging to a group, in which the increase number is smaller than the prescribed value, is not corrected. Therefore, the gradation value belonging to a group, in which the fluctuations in the gradation voltages are small, is not corrected.

Further, in the present exemplary embodiment, the correction processing circuit 110 performs the correction processing on the input display data belonging to at least one group of the groups KG2 to KG7 without performing the correction processing on the input display data belonging to the group KG1 and the group KG8.

For example, the correction processing circuit 110 may perform the correction processing on the input display data belonging to the groups KG2 to KG7. Alternatively, the correction processing circuit 110 may perform the correction processing on the input display data belonging to the groups KG1, KG2, KG7, and KG8, without performing the correction processing on the input display data belonging to the groups KG3 to KG6. The correction processing circuit 110 does not generate, for example, the number table, the increase number table, and the correction value table for groups not subject to the correction processing.

When the electro-optical panel 200 driven by the circuit device 100 is a liquid crystal display panel, the slope of the voltage-transmittance characteristics of the liquid crystal is large in the intermediate gradation, so the data voltage errors are easily visible. According to the present exemplary embodiment, by omitting the correction processing of the input display data belonging to the groups KG1, KG8 in which the data voltages errors are less visible, the computational load of the correction processing can be reduced.

Further, in the present exemplary embodiment, the correction processing circuit 110 determines the increase number Zay of the number of the input display data belonging to each group in the driving at a current time relative to the number of the input display data belonging to each group in the driving at a previous time, and performs the correction processing based on the increase number Zαγ.

In FIG. 8, for example, when taking the increase number Z22 as an example, "the number of the input display data belonging to the group in the driving at a previous time" is N26, and "the number of the input display data belonging to the group in the driving at a current time" is N27. The correction processing circuit 110 performs the correction processing based on the increase number Z22 of N27 relative to N26.

As the number of input display data belonging to the group increases, the load on the output lines of the gradation voltages belonging to the group thereof increases, whereby the voltage fluctuations of the gradation voltages thereof increase. In the present exemplary embodiment, the correction processing is performed based on the increase number of the number of input display data belonging to the group, therefore, the correction value corresponding to the voltage fluctuation due to the increase number thereof can be determined.

Further, in the present exemplary embodiment, the correction processing circuit 110 determines the correction value Cay corresponding to each group based on the increase number Zαγ, and corrects the input display data belonging to each group with the correction value Cay.

In this manner, the input display data belonging to the group is corrected by the correction value determined from the increase number of the group. As a result, the correction in group units is realized, and the computational load of the correction processing is reduced as described above.

In addition, in the present exemplary embodiment, the driving circuit DRi performs the demultiplex-driving for sequentially driving the eight pixels in the single scanning line. The correction processing circuit 110 input eight pixel data as the input display data DIi for the single scanning line, and determines the increase number Zαγ based on the driving order of the eight pixel data and the demultiplex-driving.

"The increase number of the number of the input display data belonging to each group in the driving at a current time relative to the number of the input display data belonging to each group in the driving at a previous time" depends on the driving order of the demultiplex-driving. Therefore, in the present exemplary embodiment, the increase number Zαγ is determined based on the driving order of the demultiplex-driving.

In the present exemplary embodiment, the correction processing circuit 110 determines the increase number Zαγ based on the driving order determined by a rotation processing for changing the driving order in each scanning line.

When rotation is performed in the demultiplex-driving, the driving order in each scanning line is determined by the rotation processing. In the present exemplary embodiment, the increase number Zαγ in each scanning line is determined using the driving order determined by the rotation processing. Note that when the rotation is not performed, the driving order may be fixed. Regardless of whether the rotation is performed or not, when determining the increase number Zαγ in a certain scanning line, it is sufficient that the driving order in the scanning line is known.

2. Second Detailed Configuration Example

Figure 9:
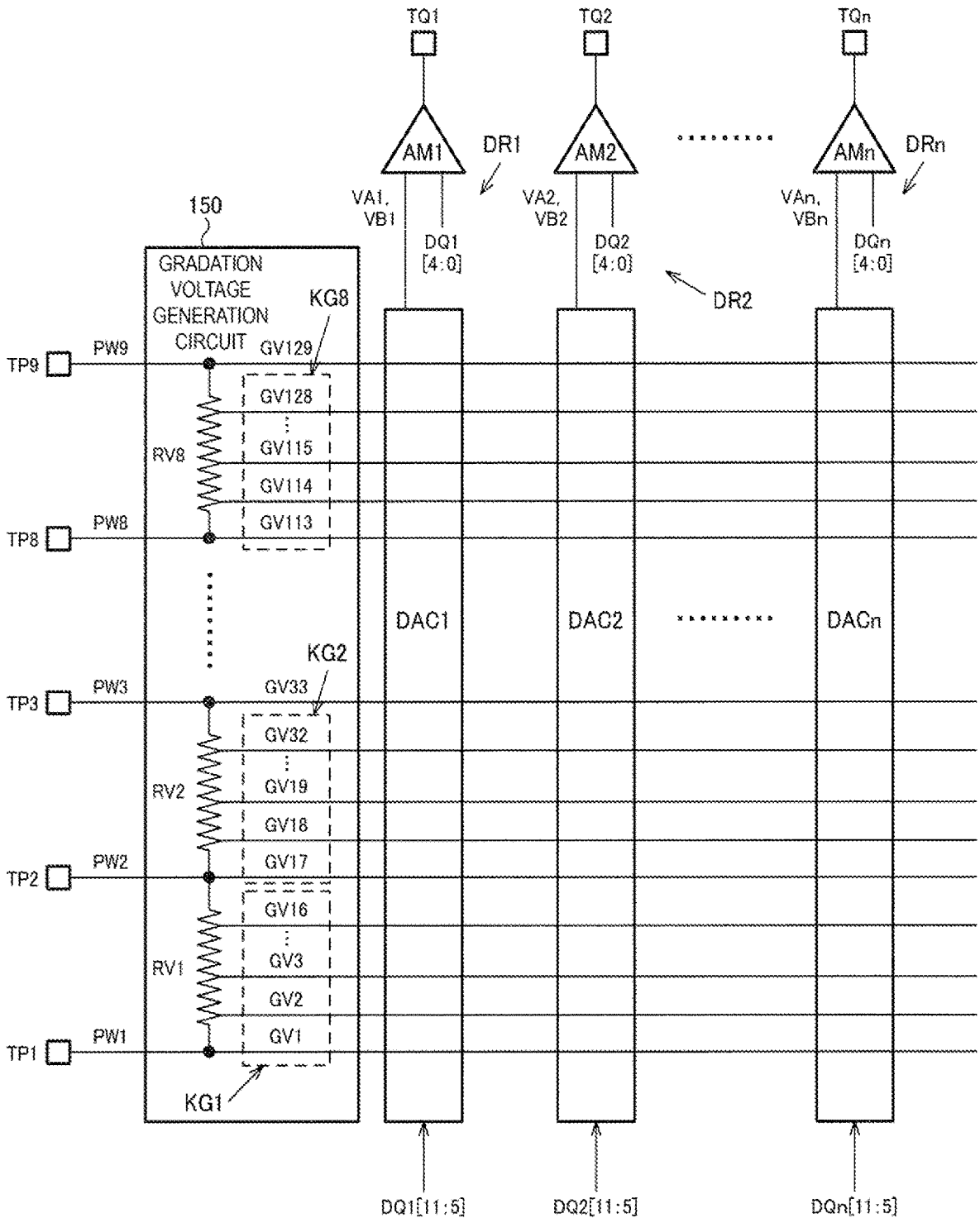
FIG. 9 is a second detailed configuration example of the gradation voltage generation circuit and the driving circuit.

FIG. 9 is a second detailed configuration example of the gradation voltage generation circuit 150 and the driving circuits DR1 to DRn. Here, it is assumed that k=8, m=129, and the display data is 12 bits. The components already described are designated by the same reference numerals, and the description of the components will be omitted as appropriate.

In the second detailed configuration example, the external power supply voltages PW1, PW2, . . . , PW8 are the gradation voltages GV1, GV17, . . . , GV113, respectively. The resistor RV1 performs the resistance division between PW1=GV1 and PW2=GV17 to output the gradation voltages GV2 to GV16. The gradation voltages GV1 to GV16 correspond to the first group KG1. Similarly, the resistors RV2, . . . , RV8 output the gradation voltages GV18 to GV32, . . . , GV114 to GV128. The gradation voltages GV17 to GV32, . . . , GV113 to GV128 correspond to the second group KG2, . . . , and the eighth group KG8. In the present configuration example, the gradation voltages corresponding to the external power supply voltages are also included in the group because the two gradation voltages are further chopped by the amplifier circuit.

The driving circuits DR1 to DRn will be described. In the present configuration example, upper bit data DQi [11:5] of the corrected display data DQi [11:0] is input to a D/A converter circuit DACi, and lower bit data DQi [4:0] is input to an amplifier circuit AMi. i is an integer of 1 to p.

The D/A converter circuit DACi D/A performs D/A conversion on the lower bit data DQi [11:5] and outputs two voltages VAi, VBi. The voltages VAi, VBi are two adjacent gradation voltages among the gradation voltages GV1 to GV128. Further, VAi<VBi. Specifically, when DQi [11:5] =0d, the D/A converter circuit DACi selects the gradation voltages GV1, GV2 and outputs them as the voltages VAi, VBi. Similarly, when DQi [11:5]=1d to 127*d*, the D/A converter circuit DACi selects the gradation voltages GV2 to GV128, GV3 to GV129, and outputs them as the voltages VAi, VBi.

The amplifier circuit AMi performs D/A conversion on the lower bit data DQi [4:0] by subdividing the voltages VAi, Vbi based on the lower bit data DQi [4:0], and outputs the data voltage VQi. Details of the amplifier circuit AMi will be described later.

FIG. 10 is a diagram illustrating a relationship between input display data DIi [11:0] and the groups KG1 to KG8.

The gradation voltages GV1, GV17 corresponding to the external power supply voltages PW1 and PW2 correspond to the input display data DIi [11:0]=000h and 200h. h denotes a hexadecimal number. When DIi [11:0]=000h to 1FFh, the D/A converter circuit DAC1 selects any of the gradation voltages GV1 to GV16 belonging to the group KG1 as a voltage VA1. Such input display data DIi [11:0]=000h to 1FFh correspond to input display data belonging to the group KG1. Similarly, input display data DIi [11:0]=200h to 3FFh, . . . , E00h to FFFh correspond to input display data belonging to the groups KG2, . . . , KG8. Note that DIi [11:0]=000h, 200h, . . . , E00h may be removed from the groups KG1, KG2, . . . , KG8.

Figure 11:
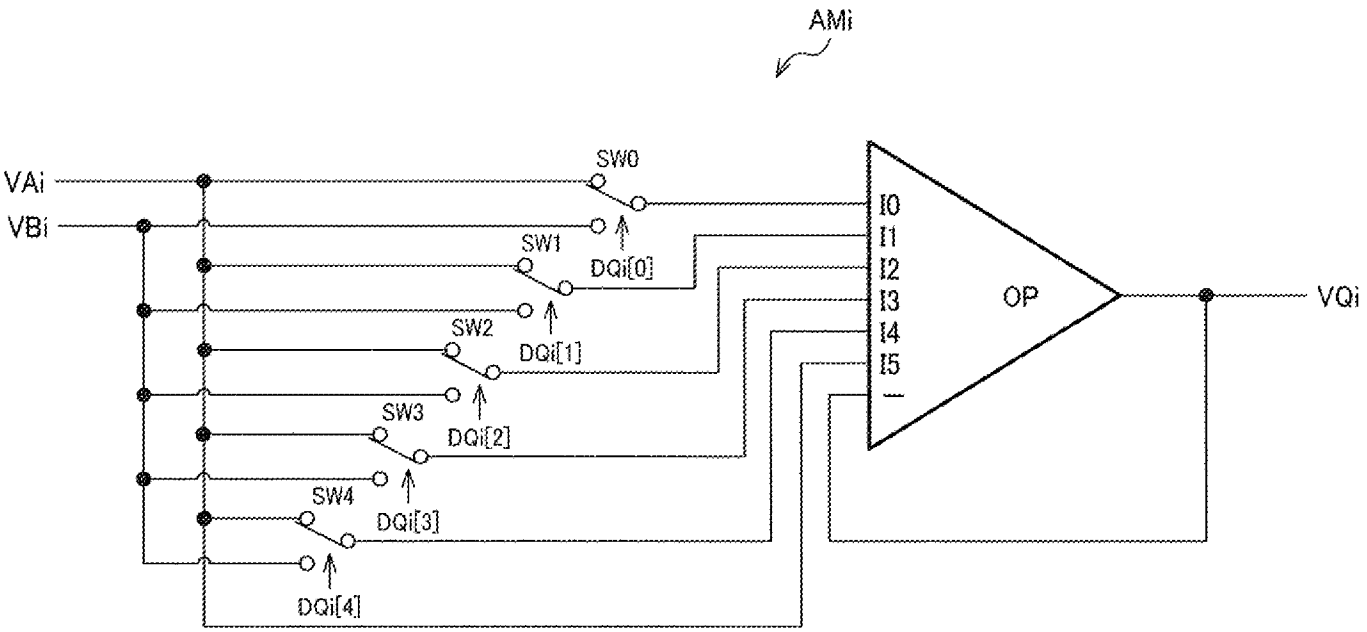
FIG. 11 is a detailed configuration example of an amplifier circuit.

FIG. 11 is a detailed configuration example of the amplifier circuit AMi. The amplifier circuit AMi includes an operational amplifier OP and switches SW0 to SW4. The switches SW0 to SW4 are analog switches configured by transistors.

Input terminals I0 to 15 of the operational amplifier OP correspond to positive input terminals. The switch SW0 connects the input terminal I0 and a node of the voltage VAi when DQi [0]=0, and connects the input terminal I0 and a node of the voltage VBi when DQi [0]=1. Similarly, the switches SW1 to SW4 connect the input terminals I1 to 14 and nodes of the voltage VAi when DQi [1] to DQi [4]=0, and connect the input terminals I1 to I4 and nodes of the voltage VBi when DQi [1] to DQi [4]=1. The input terminal 15 is coupled to a node of the voltage VAi.

The operational amplifier OP has a differential pair. On the positive side of the differential pair, transistors with the sizes weighted by $2^0$, $2^1$, $2^2$, $2^3$, $2^4$, $2^0$ are coupled in parallel. The sizes are channel widths of the transistors, and are weighted by, for example, the number of unit transistors. The input terminals I0, I1, I2, I3, I4 are coupled to gates of the transistors weighted with $2^0$, $2^1$, $2^2$, $2^3$, $2^4$. The input terminal 15 is coupled to the gate of the transistor weighted by $2^0$. A negative input terminal and an output terminal of the operational amplifier OP are coupled to each other, by which a voltage follower circuit is configured. Because the voltage VAi is input to the input terminals I0 to 15 when DQ1 [4:0]=00h, the data voltage output by the voltage follower circuit becomes VQi=VAi. When DQ1 [4:0]=01h, the voltage VBi is input to the input terminal I0 and the voltage VAi is input to the input terminals I1 to I5, resulting in VQi=VAi+(1/32)×(VBi−VAi). Hereinafter, as DQ1 [4: 0] increases by 1, VQi is chopped by (1/32)×(VBi−VAi). Thus when DQ1 [4: 0]=1Fh, VQi=VAi+(31/32)×(VBi−VAi).

Figure 12:
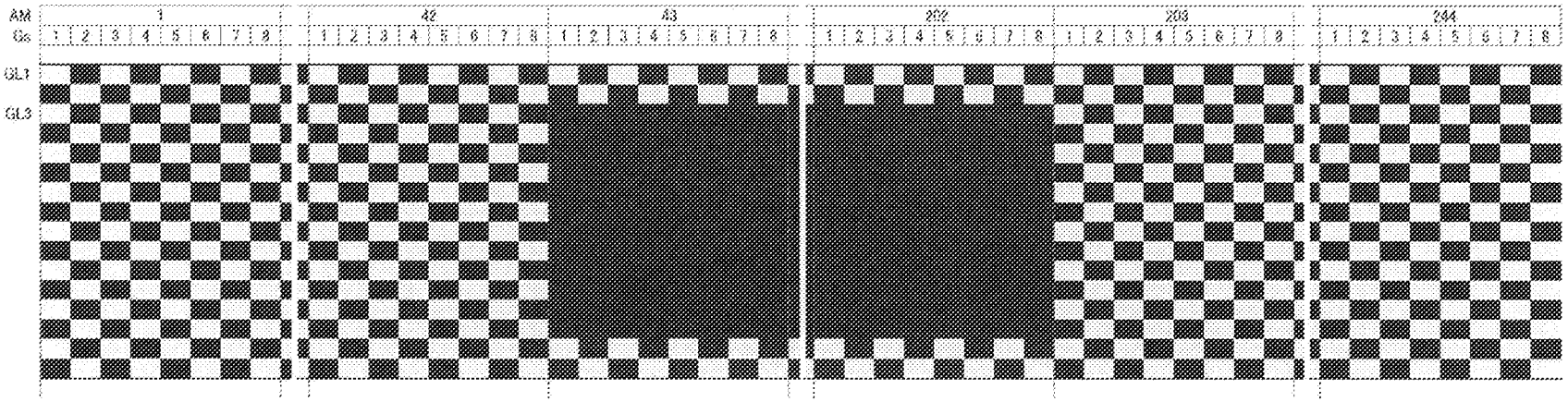
FIG. 12 is an example of an image in which fluctuations in gradation voltages are prone to occur.

FIG. 12 illustrates an image in which a window is provided in a checkerboard pattern, as an example of an image in which fluctuations in the gradation voltages are prone to occur. Hereinafter, the operation of the second detailed configuration example will be described below using this image example.

In FIG. 12, it is assumed that n=244, and the number of demultiplexes is 8. Each of rectangles arranged in a matrix illustrates a pixel. Here, a driving order that does not account for rotation is illustrated. In other words, in FIG. 12, the amplifier circuits AM1 to AM244 sequentially drive eight pixels arranged in the horizontal scanning direction during the driving periods Gs1 to Gs8. The gradation value of black pixels is 000h, and the gradation value of the pixel hatched thinner than that is B00h. As illustrated in FIG. 10, the gradation value 000h belongs to the group KG1, while the gradation value B00h belongs to the group KG6.

Note that in FIG. 12, only regions driven by the amplifier circuits AM1, AM42, AM43, AM202, AM203, and AM244 are illustrated. The same pattern is repeated in the omitted portion. In other words, a region driven by the amplifier circuits AM2 to AM41 has the same image pattern as the region driven by the amplifier circuits AM1 and AM42. A region driven by the amplifier circuits AM44 to AM201 has the same image pattern as the region driven by the amplifier circuits AM43 and AM202. A region driven by the amplifier circuits AM204 to AM243 has the same image pattern as the region driven by the amplifier circuits AM203 and AM244.

FIG. 13 is a number table and an increase number table upon driving the pixels coupled to the scanning line GL1 in FIG. 12. It is assumed that PX1 to PX8 are pixels driven by each of the driving circuits in the single horizontal scanning period, and are arranged in the horizontal scanning direction in that order. Here, it is assumed that rotation is not performed, and the pixels PX1 to PX8 are driven in this order during the driving periods Gs1 to Gs8.

The number table is illustrated on the top row of FIG. 13. In the scanning line GL1, pixels having a gradation value of B00h and pixels having a gradation value of 000h are alternately aligned. Thus, the numbers of the group KG6 during the driving periods Gs1, Gs3, Gs5, and Gs7 are 244, and the numbers of group KG1 during the driving periods Gs2, Gs4, Gs6, and Gs8 are 244. The gradation value corresponding to the pre-charge voltage is 700h. The **700*h* belongs to KG4**.

The increase number table is illustrated in the bottom row of FIG. 13. Since the number of the group KG1 increases from 0 to 244 over the driving period Gs1 through Gs2, the increase number of the group KG1 during the driving period Gs2 is 244. On the other hand, since the number of the group KG6 decreases from 244 to 0 over the driving period Gs1 through Gs2, the increase number of the group KG6 during the driving period Gs2 is 0. During the driving period Gs2, the increase number of the group KG1 is 244, and the correction processing circuit 110 determines the corrected gradation value for the gradation value 000h according to Equation (2) below. 1/32 is the coefficient Prm of the above formula (1), and +1 is the orientation Dir of the above formula (1).

$$\text{Corrected gradation value}=000h+(244\times(1/32)\times(-1))=-008h \quad (2)$$

The correction processing circuit 110 clips the corrected gradation value to 000h or FFFh in a case where the corrected gradation value underflows 000h or overflows FFFh. In other words, the correction processing circuit 110 clips the corrected gradation value −008h of the above Equation (2) to 000h.

In FIG. 13, since the number of the group KG1 decreases from 244 to 0 over the driving period Gs2 through Gs3, the increase number of the group KG1 during the driving period Gs3 is 0. Since the number of the group KG6 increases from 0 to 244 over the driving period Gs2 through Gs3, the increase number of the group KG6 during the driving period Gs2 is 244. During the driving period Gs3, the increase number of the group KG6 is 244, and the correction processing circuit 110 determines the corrected gradation value according to Equation (3) below. 1/32 is the coefficient Prm of the above formula (1), and +1 is the orientation Dir of the above formula (1).

Corrected Gradation $$\text{value}=B00h+(244\times(1/32)\times(+1))=B08h \quad (3)$$

However, the correction processing circuit 110 has a correction amount within a range of −31d to +31d. That is, the correction processing circuit 110 limits a bit number of the correction value to the same bit number as the lower bit data DQi [4:0]. Furthermore, the correction processing circuit 110 limits the correction amount to a range that the upper bit data DQ1 [11:5] is not changed, in other words, the correction amount is limited to a range that only the lower bit data DQi [4:0] is changed. For example, in Equation (3) above, the lower bit data DQi [4:0]=00h. At this time, the correction processing circuit 110 performs correction so that the upper bit data DQ1 [11:5] does not change before and after the correction, and thus the correction amount is limited to a range of 00h to +1Fh. When the correction amount is less than ooh, the correction amount is limited to the lower limit of ooh. When the correction amount is greater than +1F, the correction amount is limited to the upper limit of +1Fh. In Equation (3) above, the correction amount is +08h, and is within the range of 00h to +1Fh, whereby the correction processing circuit 110 adopts the correction amount +08h as it is, and sets the corrected gradation value to B08h. As another example, when the lower bit data DQi [4:0]=08h, the correction processing circuit 110 performs correction so that the upper bit data DQ1 [11:5] does not change before and after the correction, and thus the correction amount is limited to a range of −8h to +17h. When the correction amount is less than −8h, the correction amount is limited to the lower limit of −8h. When the correction amount is greater than +17h, the correction amount is limited to the upper limit of +17d.

FIG. 14 is a number table and an increase number table upon driving the pixels in the scanning line GL3 in FIG. 12. Rotation is not performed in the same manner as in FIG. 13.

The number table is illustrated on the top row of FIG. 14. Since the scanning line GL3 passes through the window, the number table is different from that of the scanning line GL1 having only the checkerboard pattern. The window portion corresponds to 160 amplifier circuits with the gradation value of 000h, and the checkerboard pattern with 000h and B00h corresponds to 84 amplifier circuits. Thus, the numbers of the group KG6 during the driving periods Gs1, Gs3, Gs5, and Gs7 are 84, and the number of the group KG1 is 160. During the driving periods Gs2, Gs4, Gs6, and Gs8, the numbers of the group KG1 is 244.

Although the increase number table is determined by the same calculation as in FIG. 13, the window portion does not contribute to the increase number, thereby reducing the increase number compared to that of FIG. 13. For example, during the driving period Gs3, the increase number of the group KG6 to which the gradation value B00h belongs is 84. The correction processing circuit 110 determines the corrected gradation value for the gradation value B00h according to Equation (4) below. Since the increase number is smaller than 244 in FIG. 13, the correction amount is also reduced.

$$\text{Corrected gradation value}=B00h+(84\times(1/32)\times(+1))=B02h \quad (4)$$

FIG. 15 is a number table and an increase number table in a case where the rotation is performed. Here, an example is illustrated in which the pixels PX6, PX7, PX8, PX1, PX2, PX3, PX4, PX5 are driven in this order during the driving periods Gs1 to Gs8. In accordance with this driving order, the number table of FIG. 14 is reordered. The calculation rules for the increase number table and the calculation technique for the correction value are the same as in FIGS. 13 and 14.

Figure 16:
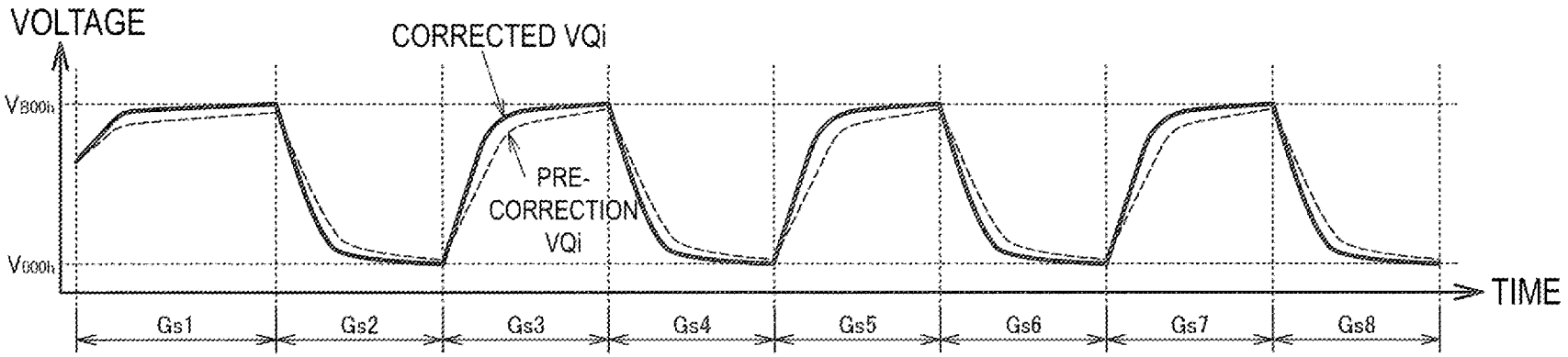
FIG. 16 is an example of a waveform of the data voltage.

FIG. 16 is an example of a waveform of the data voltage VQi. A pre-correction VQi is a waveform of the data voltage VQi when the correction processing of the present exemplary embodiment is not applied. A corrected VQi is a waveform of the data voltage VQi when the correction processing of the present exemplary embodiment is applied. $V_{000h}$ is an ideal data voltage when the gradation value of the display data is 000h. $V_{B00h}$ is an ideal data voltage when the gradation value of the display data is B00h. The pre-correction VQi has an error with respect to the ideal data voltage at the end of each driving period, while the corrected VQi has a reduced error with respect to the ideal data voltage at the end of each driving period.

According to the second detailed configuration example described above, the driving circuit DRi includes the D/A converter circuit DACi and the amplifier circuit AMi. The D/A converter circuit DACi outputs two adjacent gradation voltages among the gradation voltages GV1 to GV129 by the D/A conversion the upper bit data DQi [11:5] of the corrected display data. The amplifier circuit AMi performs the D/A conversion on the lower bit data DQi [4:0] of the corrected display data by subdividing the two gradation voltages thereof with the lower bit data DQi [4:0] of the corrected display data. The correction processing circuit 110 limits the correction value for the input display data DIi [11:0] to the same bit number as the lower bit data DQi [4:0].

In the present configuration example, since the correction value is limited to 5 bits, the correction value is limited to −31d to +31d as described above. In this manner, the upper bit data DQ1 [11:5] fluctuates at most ±1d, whereby the group to which the gradation value belongs does not change. By not performing the correction over the group, the number table does not need to be calculated again because the number of the groups is not changed, resulting in the reduced computation cost.

3. Electro-Optical Device and Electronic Apparatus

Figure 17:
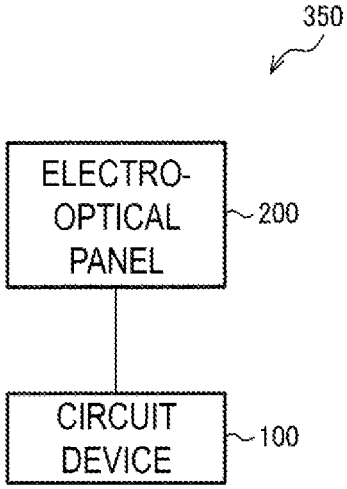
FIG. 17 is a configuration example of an electro-optical device.

FIG. 17 illustrates an example of a configuration of an electro-optical device 350 including the circuit device 100. The electro-optical device 350 includes the circuit device 100 and the electro-optical panel 200.

For example, the circuit device 100 is mounted at a flexible substrate, the flexible substrate is coupled to the electro-optical panel 200. The data signal output terminal of the circuit device 100 and the data signal input terminal of the electro-optical panel 200 are coupled by the wiring formed at the flexible substrate. Alternatively, the circuit device 100 may be mounted at a rigid substrate, the rigid substrate and the electro-optical panel 200 may be coupled via the flexible substrate. The data voltage output terminal of the circuit device 100 and the data voltage input terminal of the electro-optical panel 200 may be coupled by the wiring formed at the rigid substrate and the flexible substrate.

Figure 18:
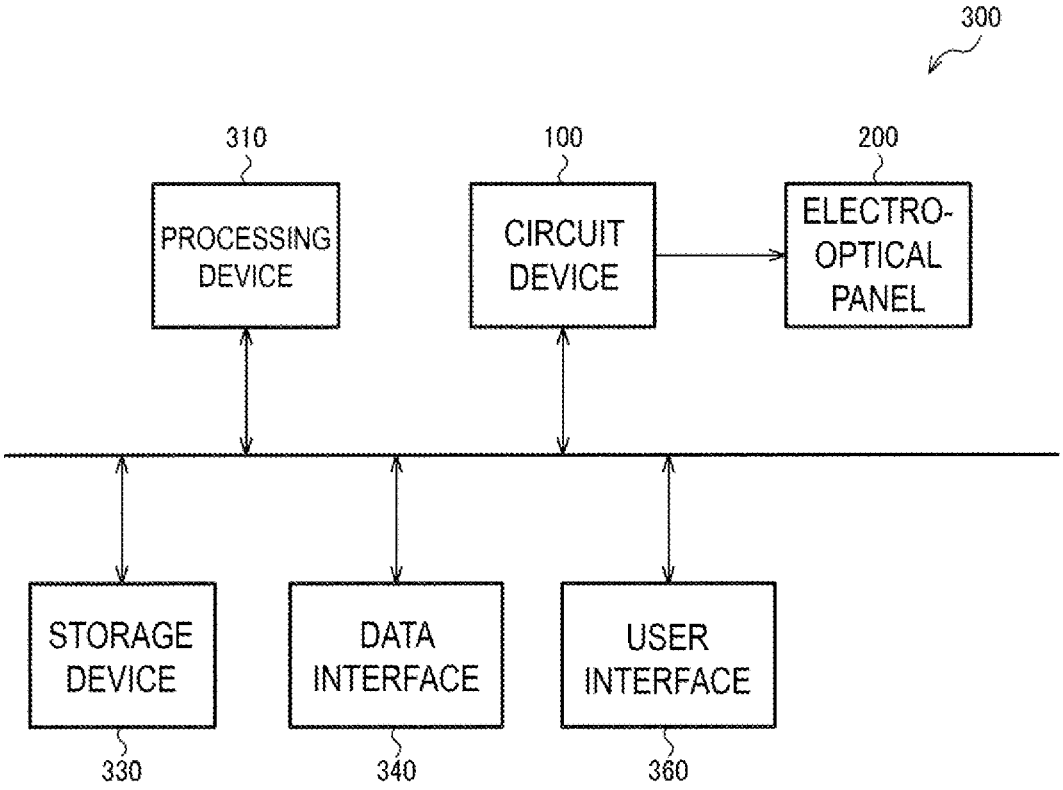
FIG. 18 is a configuration example of an electronic apparatus.

FIG. 18 illustrates an example of a configuration of an electronic apparatus 300 including the circuit device 100. The electronic apparatus 300 includes a processing device 310, the circuit device 100, the electro-optical panel 200, a storage device 330, a data interface 340, and a user interface 360. Specific examples of the electronic apparatus 300 may include various electronic apparatuses provided with display devices, such as a projector, a head-mounted display, a mobile information terminal, a vehicle-mounted device, a portable game terminal, and an information processing device, for example. The vehicle-mounted device is, for example, a meter panel, a car navigation system, etc.

The user interface 360 receives various operations from a user. The user interface 360 is, for example, a button, a mouse, a keyboard, a touch panel mounted at the electro-optical panel 200, etc. The data interface 340 inputs and outputs image data and control data. The data interface 340 is, for example, a wireless communication interface such as a wireless LAN or a near field wireless communication, or a wired communication interface such as a wired LAN or USB. The storage device 330 stores, for example, data input from the data interface 340, or functions as a working memory of the processing device 310. The storage device 330 is, for example, a memory, such as a RAM or a ROM, a magnetic storage device, such as an HDD, or an optical storage device, such as a CD drive or a DVD drive. The processing device 310 carries out control processing for the electronic apparatus 300 and various types of signal processing. The processing device 310 is, for example, a processor, such as a CPU or an MPU, or an ASIC. Alternatively, the processing device 310 may be a display controller, or may be configured by both a processor and a display controller. The processing device 310 processes the image data input from the data interface 340 or stored in the storage device 330, and transfers the image data to the circuit device 100. The circuit device 100 causes the electro-optical panel 200 to display an image based on the image data transferred from the display controller 320.

For example, in a case where the electronic apparatus 300 is a projector, the electronic apparatus 300 further includes a light source and an optical system. The optical system is, for example, a lens, a prism, a mirror, etc. In the case where the electro-optical panel 200 is of a transmissive type, the optical device emits light from the light source to the electro-optical panel 200, and the light transmitted through the electro-optical panel 200 is projected on a screen. In the case where the electro-optical panel 200 is of a reflective type, the optical device emits light from the light source to the electro-optical panel 200, and the light reflected at the electro-optical panel 200 is projected on a screen.

The circuit device of the present exemplary embodiment described above includes the gradation voltage generation circuit, the correction processing circuit, and the first to n-th driving circuits. The gradation voltage generation circuit generates the first to m-th gradation voltages. m is an integer of 3 or greater. The correction processing circuit performs the correction processing on the i-th input display data of the first to n-th input display data, and outputs the i-the corrected display data of the first to n-th corrected display data. n is an integer of 3 or greater. i is an integer of 1 to p. The i-the driving circuit of the first to n-th driving circuits drives the electro-optical panel by outputting the gradation voltage corresponding to the i-th corrected display data based on the first to the m-th gradation voltages. The first to m-th gradation voltages are grouped into the first to the k-th groups. k is an integer of 2 or greater and less than m. At this time, the correction processing circuit determines, by analyzing which group of the first to the k-th groups each input display data of the first to n-th input display data belongs to, a number of the input display data belonging to each group of the first to the k-th groups, and performs the correction processing based on the determined number.

In this manner, the number of driving circuits that have selected the gradation voltages belonging to each group is determined, whereby the input display data is corrected in accordance with the number thereof. The data voltage errors differ depending on the number of the amplifier circuits coupled to the output lines of the gradation voltages. However, according to the present exemplary embodiment, by correcting on the data side in accordance with the number thereof, the data voltage errors can be brought close to an ideal value.

Further, in the present exemplary embodiment, the circuit device may include the first to k+1-th external power supply input terminals, to which the first to k+1-th external power supply voltages are input. The gradation voltage generation circuit may generate the gradation voltage belonging to the p-th group of the first to k-th groups by performing the resistance-division between the p-th external power supply voltage and the p+1-th external power supply voltage of the first to k+1-th external power supply voltages. p is an integer of 1 to k.

The gradation voltages corresponding to the external power supply voltages are considered to have small voltage fluctuations even when the load is large. On the other hand, the gradation voltages are coupled to an external power source via a resistor, so when the load is large, voltage fluctuations occur. In the present exemplary embodiment, by grouping the gradation voltages with which the resistance-divided is performed between the external power supply voltages, the data voltage fluctuation can be corrected in group units.

Further, in the present exemplary embodiment, the correction processing circuit may perform the correction processing so that the gradation value of the input display data belonging to the p-th group does not exceed the gradation value corresponding to the p-th external power supply voltage and the p+1-th external power supply voltage.

Since the gradation voltages corresponding to the external power supply voltages hardly fluctuate, it is considered that the correction may be performed within a range that does not exceed the gradation voltages corresponding to the external power supply voltages. In the present exemplary embodiment, the input display data is corrected so as not to exceed the gradation values corresponding to the external power supply voltages, and thus no correction is performed beyond the external power supply voltages.

Further, in the present exemplary embodiment, the correction processing circuit may perform the correction processing on the input display data belonging to, among the first to k-th groups, the group in which the number determined by the analysis at a current time is increased by the prescribed value equal to or greater than the number determined by the analysis at a previous time.

The gradation voltages, which belong to a group with a small increase number, have a small voltage fluctuation due to a small load, and thus the effect on the data voltages thereof may be ignored. According to the present exemplary embodiment, the gradation value belonging to a group, in which the increase number is smaller than the prescribed value, is not corrected. Therefore, the gradation value belonging to a group, in which the fluctuations in the gradation voltages are small, is not corrected.

Further, in the present exemplary embodiment, the correction processing circuit may perform the correction processing on the input display data belonging to at least one group among the second to k−1-th groups of the first to k-th groups without perform the correction processing on the input display data belonging to the first group and the k-th group of the first to k-th groups.

When the electro-optical panel driven by the circuit device is a liquid crystal display panel, the slope of the voltage-transmittance characteristics of the liquid crystal is large in the intermediate gradation, so the data voltage errors are easily visible. According to the present exemplary embodiment, the correction processing of the input display data belonging to the first group and the k-th group, in which the data voltages errors are less visible, is omitted. As a result, the computational load of the correction processing can be reduced.

In the present exemplary embodiment, the i-th driving circuit may include the D/A converter circuit and the amplifier circuit. The D/A converter circuit may output two adjacent gradation voltages among the first to m-th gradation voltages by the D/A conversion on the upper bit data of the i-th corrected display data. The amplifier circuit may perform the D\A conversion on the lower bit data by subdividing the two gradation voltages with the lower bit data of the i-th corrected display data. The correction processing circuit may limit the correction value for the i-th input display data to the same bit number as the lower bit data.

In this manner, since the correction value is limited to the same bit number as the lower bit data, the fluctuation in the upper bit data before and after the correction is at most ±1d. As a result, the group to which the gradation value belongs does not change before and after the correction. By not performing the correction over the group, the number table does not need to be calculated again because the number of the groups is not changed, resulting in the reduced computation cost.

Further, in the present exemplary embodiment, the correction processing circuit may determine the increase number of the number of the input display data belonging to each group in the driving of current time to the number of the input display data belonging to each group in the driving at a previous time, and perform the correction processing based on the increase number.

As the number of input display data belonging to the group increases, the load on the output lines of the gradation voltages belonging to the group thereof increases, whereby the voltage fluctuations of the gradation voltages thereof increase. In the present exemplary embodiment, the correction processing is performed based on the increase number of the number of input display data belonging to the group, therefore, the correction value corresponding to the voltage fluctuation due to the increase number thereof can be determined.

Further, in the present exemplary embodiment, the correction processing circuit may determine the correction value corresponding to each group based on the increase number, and may correct the input display data belonging to each group with the correction value.

In this manner, the input display data belonging to the group is corrected by the correction value determined from the increase number of the group. As a result, the correction in group units is realized, and the computational load of the correction processing is reduced as described above.

In the present exemplary embodiment, the i-th driving circuit may perform the demultiplex-driving for sequentially driving m pixels in the single scanning line. The correction processing circuit may input the m pixel data as the i-th input display data for the single scanning line, and may determine the increase number based on the driving order of the m pixel data and the demultiplex-driving.

The increase number of the number of input display data belonging to each group in the driving at a current time relative to the number of input display data belonging to each group in the driving at a previous time depends on the driving order of the demultiplex-driving. Therefore, in the present exemplary embodiment, the increase number is determined based on the driving order of the demultiplex-driving.

In the present exemplary embodiment, the correction processing circuit may determine the increase number based on the driving order determined by the rotation processing for changing the driving order in each scanning line.

When rotation is performed in the demultiplex-driving, the driving order in each scanning line is determined by the rotation processing. In the present exemplary embodiment, the increase number in each scanning line is determined using the driving order determined by the rotation processing.

Further, the electro-optical device of the present exemplary embodiment includes the circuit device and the electro-optical panel described in any one of the above.

Further, the electronic apparatus of the present exemplary embodiment includes the above-described circuit device described in any one of the above.

Although the present exemplary embodiment has been described in detail above, a person skilled in the art will easily understand that many modifications can be made without substantially departing from novel items and effects of the present disclosure. All such modified examples are thus included in the scope of the disclosure. For example, terms in the descriptions or drawings given even once along with different terms having identical or broader meanings can be replaced with those different terms in all parts of the descriptions or drawings. All combinations of the embodiment and modified examples are also included within the scope of the disclosure. Further, the configurations and operations, etc. of the circuit device, the electro-optical panel, the electro-optical device and the electronic apparatus, etc. are not limited to those described in the embodiment, and various modifications thereof are possible.

What is claimed is:

1. A circuit device, comprising:

a gradation voltage generation circuit configured to generate first to m-th gradation voltages, m being an integer of 3 or greater;

a correction processing circuit configured to, by performing correction processing on i-th input display data of first to n-th input display data, output i-th corrected display data of first to n-th corrected display data, i being an integer of 1 to n, n being an integer of 3 or greater; and first to n-th driving circuits configured to drive an electro-optical panel by an i-th driving circuit thereof outputting, based on the first to m-th gradation voltages, a gradation voltage corresponding to the i-th corrected display data, wherein when the first to m-th gradation voltages are grouped into first to k-th groups with k being an integer of 2 or greater and less than m, the correction processing circuit is configured to, by analyzing which group of the first to k-th groups each input display data of the first to n-th input display data belong to, determine a number of the input display data belonging to each group of the first to k-th groups, and perform the correction processing based on the determined number.

2. The circuit device according to claim 1, comprising first to k+1-th external power supply input terminals into which first to k+1-th external power supply voltages are input, wherein the gradation voltage generation circuit is configured to, by performing resistance-division between a p-th external power supply voltage and a p+1-th external power supply voltage of the first to k+1-th external power supply voltages, generate a gradation voltage belonging to a p-th group of the first to k-th groups, p being an integer of 1 to k.

3. The circuit device according to claim 2, wherein the correction processing circuit is configured to perform the correction processing so that a gradation value of the input display data belonging to the p-th group does not exceed a gradation value corresponding to the p-th external power supply voltage and the p+1-th external power supply voltage.

4. The circuit device according to claim 1, wherein the correction processing circuit is configured to perform the correction processing on input display data belonging to, among the first to k-th groups, a group for which the number determined by the current analysis is greater than the number determined by the previous analysis by a prescribed value or more.

5. The circuit device according to claim 1, wherein the correction processing circuit is configured to perform the correction processing on input display data belonging to at least one group among second to k−1-th groups of the first to k-th groups without performing the correction processing on input display data belonging to a first group and k-th group of the first to k-th groups.

6. The circuit device according to claim 1, wherein the i-th driving circuit includes a D/A converter circuit configured to output two adjacent gradation voltages among the first to m-th gradation voltages by D/A conversion on upper bit data of the i-th corrected display data and an amplifier circuit configured to perform the D/A conversion on lower bit data by subdividing a difference between the two gradation voltages based on the lower bit data of the i-th corrected display data, and the correction processing circuit is configured to limit a correction value for the i-th input display data to the same bit number as the lower bit data.

7. The circuit device according to claim 1, wherein the correction processing circuit is configured to determine an increase from a number of input display data belonging to each of the groups in the previous driving to a number of input display data belonging to each of the groups in the current driving, and perform the correction processing based on the increase.

8. The circuit device according to claim 7, wherein the correction processing circuit is configured to determine a correction value corresponding to each of the groups based on the increase, and correct input display data belonging to each of the groups with the correction value.

9. The circuit device according to claim 7, wherein the i-th driving circuit is configured to perform demultiplex-driving for sequentially driving m pixels in a single scanning line, and the correction processing circuit is configured to receive m pixel data as the i-th input display data for the single scanning line, and determine the increase based on the m pixel data and a driving order of the demultiplex-driving.

10. The circuit device according to claim 9, wherein the correction processing circuit is configured to determine the increase based on the driving order determined by a rotation processing for changing the driving order in each scanning line.

11. An electro-optical device comprising:

the circuit device according to claim 1; and the electro-optical panel.

12. An electronic apparatus comprising the circuit device according to claim 1.

* * * * *